US007147046B2

(12) United States Patent
Sanada et al.

(10) Patent No.: US 7,147,046 B2
(45) Date of Patent: Dec. 12, 2006

(54) HEAT EXCHANGER OF A MULTIPLE TYPE

(75) Inventors: Ryouichi Sanada, Oobu (JP); Atsushi Hayasaka, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/994,985

(22) Filed: Nov. 22, 2004

(65) Prior Publication Data

US 2005/0217832 A1 Oct. 6, 2005

(30) Foreign Application Priority Data

Nov. 27, 2003 (JP) ..... 2003-397766
Nov. 27, 2003 (JP) ..... 2003-397767
Mar. 5, 2004 (JP) ..... 2004-062235

(51) Int. Cl.
*F28F 9/26* (2006.01)

(52) U.S. Cl. ..... 165/140; 165/149; 165/67

(58) Field of Classification Search ..... 165/67, 165/140, 149–153
See application file for complete search history.

(56) References Cited

U.S. PATENT DOCUMENTS 2,505,790 A * 5/1950 Panthofer ..... 165/140
4,137,982 A * 2/1979 Crews et al. ..... 165/67
4,367,793 A * 1/1983 MacIntosh ..... 165/151
4,651,816 A * 3/1987 Struss et al. ..... 165/140
5,197,538 A * 3/1993 Nagasaka et al. ..... 165/144
6,907,916 B1 * 6/2005 Koyama ..... 165/67
2002/0056541 A1 * 5/2002 Kokubunji et al. ..... 165/67

FOREIGN PATENT DOCUMENTS

JP 3301158 10/1994

* cited by examiner

*Primary Examiner*—Teresa J. Walberg
(74) *Attorney, Agent, or Firm*—Harness, Dickey & Pierce, PLC

(57) ABSTRACT

Even in the case where an additional heat exchanger must be arranged at the downstream side in the air flow direction of a multiple heat exchanger, a high flow-rate of air can be supplied to the additional heat exchanger arranged at the downstream side. In a state in which a reinforcement plate 3*d* of an outdoor heat exchanger 3 and a reinforcement plate 2*d* of a first radiator 2 come next to and overlap each other in series in the cooling air flow direction, both the reinforcement plates 2*d* and 3*d* are joined with a bolt 5. Due to this, a distance h between a first heat exchange core 2*c* and a second heat exchange core 3*c* is reduced. Therefore, air for cooling can be supplied, at a high flow-rate, to a second radiator 3 arranged at the downstream side.

22 Claims, 25 Drawing Sheets

(A)

(B)

[MULTIPLE HEAT EXCHANGER UNDER EXAMINATION]

[MULTIPLE HEAT EXCHANGER UNDER EXAMINATION]

[MULTIPLE HEAT EXCHANGER UNDER EXAMINATION]

HEAT EXCHANGER OF A MULTIPLE TYPE

BACKGROUND OF THE INVENTION

1. Field of the Invention

The present invention relates to a multiple heat exchanger (heat exchanger module) comprising two or more heat exchangers 2. Description of the Related Art A heat exchanger such as a radiator or a condenser generally comprises a heat exchange core including a plurality of tubes through which a fluid flows and fins provided on the outer surfaces of the tubes, reinforcement plates for reinforcing the heat exchange core, etc. (for example, refer to Patent document 1).

Conventionally, a heat exchanger is assembled to a vehicle etc. by assembling one end of a metal bracket to a reinforcement plate with a bolt, and the other end of the bracket to the body of the vehicle with a bolt.

Patent Document 1

Japanese Patent Publication No. 3301158

Recently, there is an increasing need for a multiple heat exchanger comprising two or more heat exchangers, in which a condenser of an air conditioner for a vehicle and an oil cooler for cooling engine oil and ATF (automatic transmission fluid) are coupled in a state in which the condenser and the oil cooler are arranged in parallel to the air flow direction, or a radiator for an engine (internal combustion engine) and a radiator for cooling an electric motor for running a vehicle, an inverter circuit for supplying a drive current to the electric motor, etc. are coupled in a state in which both radiators are arranged in parallel to the air flow direction.

The present inventors, as shown in FIG. 29, examined a multiple heat exchanger composed of two heat exchangers coupled by fixing brackets fixed on reinforcement plates. In this multiple heat exchanger, two reinforcement plates 1200 and 1201 and brackets 1202 and 1203 are arranged as a coupling means between a heat exchange core 1002*a* of a first heat exchanger and a heat exchange core 1003*a* of a second heat exchanger.

Therefore, as the space between the heat exchange core of the first heat exchanger and the heat exchange core of the second heat exchanger are blocked by the two reinforcement plates and the two brackets, in the case where an additional heat exchanger needs to be arranged at the downstream side of the air flow in the multiple heat exchanger, there is a possibility that a portion of the heat exchange core of the additional heat exchanger arranged at the downstream side corresponding to the space between the heat exchange core of the first heat exchanger and the heat exchange core of the second heat exchanger may not be supplied with air for heat exchange at a sufficient flow-rate.

As a result, the range of a length h0 between the heat exchange core 1002*a* of the first heat exchanger and the heat exchange core 1003*a* of the second heat exchanger is a portion of the heat exchange cores 1002*a* and 1003*a*, through which no fluid flows, and therefore the portion is a dead space that does not contribute to heat exchange. As the volume of a storage space for a heat exchanger in a vehicle body is limited, if the dead space increases, the areas of the heat exchange cores 1002*a* and 1003*a* are relatively reduced and heat exchange capability of the multiple heat exchanger as a whole will decrease. Accordingly, in order to gain the maximum heat exchange capability within the limited storage space, there is a need to reduce this dead space to as small as possible.

As the space between the heat exchange core 1002*a* of the first heat exchanger and the heat exchange core 1003*a* of the second heat exchanger are blocked by the two reinforcement plates and the two brackets, in the case where an additional heat exchanger 1004 is arranged at the downstream side of the air flow in the multiple heat exchanger, there is a possibility that a portion of the heat exchange core of the additional heat exchanger 1004 arranged at the downstream side, and corresponding to the space between the heat exchange core 1002*a* of the first heat exchanger and the heat exchange core 1003*a* of the second heat exchanger cannot be supplied with air for heat exchange at a sufficient flow-rate.

As shown in FIG. 30, the inventors examined a multiple heat exchanger in which a reinforcement plate 2002*d* of a first heat exchange core 2002*c* and a bracket 2010 are fixed with a bolt 2011 and a nut 2011*a*, and a reinforcement plate 2003*d* of a second heat exchange core 2003*c* and a bracket 2010 are fixed with a bolt 2012 and a nut 2012*a*.

However, in this multiple heat exchanger under examination, as the bolts 2011 and 2012 penetrate through the reinforcement plates 2002*d* and 2003*d*, the sections of which are formed substantially into a laid-down U-shape, and the bracket 2010, the maximum width of the multiple heat exchanger, that is, the maximum size of the portion parallel to the air flow direction in the multiple heat exchanger coincides with the whole length of the bolts 2011 and 2012.

In other words, if the first heat exchange core 2002*c* and the second heat exchange core 2003*c* are coupled via the bracket 2010 with bolts, the maximum size of the multiple heat exchanger exceeds the width of the first heat exchange core 2002*c* or the width of the second heat exchange core 2003*c*.

For example, as shown in FIG. 31, if a multiple heat exchanger 2001 and another heat exchanger 2004 are arranged in series in the air flow direction, there is a need to provide a space having a size d in order to prevent interference between the multiple heat exchanger 2001 and the heat exchanger 2004. However, if a maximum width A of the multiple heat exchanger 2001 increases, a width D of the whole heat exchange device including the multiple heat exchanger 2001 and the heat exchanger 2004 increases.

In a vehicle, the heat exchange device including the multiple heat exchanger 2001 and the heat exchanger 2004 is generally mounted on a front end of the vehicle, and if the width D of the heat exchange device increases, it will be difficult to reserve a large space (a crushable zone) to absorb a shock caused by a head-on collision of the vehicle.

Moreover, if the size of the space between the heat exchange cores of the multiple heat exchanger 2001, that is, between the first and second heat exchange cores and the heat exchange cores of the heat exchanger 2004 increases, there is a possibility that air having passed through the heat exchange core at the upstream side of the air flow may flow through the space between the heat exchange core at the upstream side of the air flow and the heat exchange core at the downstream side of the air flow, in other words, the air may flow through the space between the heat exchange core of the multiple heat exchanger 2001 and the heat exchange core of the heat exchanger 2004, flowing downstream while skirting the heat exchange core at the downstream side of the air flow.

In other words, if the space between the heat exchange core of the multiple heat exchanger 2001 and the heat exchange core of the heat exchanger 2004 increases, the flow rate of air to be supplied to the heat exchange core at the downstream side of the air flow will decrease and, therefore, the capability of the heat exchanger at the downstream side of the air flow will decrease.

SUMMARY OF THE INVENTION

The above-mentioned problem being taken into consideration, a first object of the present invention is to provide a novel multiple heat exchanger different from conventional multiple heat exchangers, and a second object is, even when an additional heat exchanger has to be arranged at the downstream side of the air flow with respect to the multiple heat exchanger, to supply air for heat exchange to the additional heat exchanger arranged at the downstream side, at a high flow-rate.

Another object of the present invention is to enhance the heat exchange capability of a multiple heat exchanger by minimizing a dead space occupied by a coupling means between a first heat exchanger and a second heat exchanger in the multiple heat exchanger.

Moreover, another object of the present invention is, even when another heat exchanger is arranged at the downstream side of the air flow in the multiple heat exchanger, to supply air for heat exchange to the exchanger arranged at the downstream side, at a high flow-rate.

Still moreover, yet another object of the present invention is to prevent the maximum width of a multiple heat exchanger from exceeding the width of a first heat exchange core or the width of a second heat exchange core.

In order to attain the above-mentioned objects, a multiple heat exchanger according to a first aspect of the present invention comprises: a first heat exchanger (2) having a heat exchange core (2*c*) including a plurality of tubes (2*a*) through which a fluid flows and fins (2*b*) provided on the outer surfaces of the tubes (2*a*), and reinforcement plates (2*d*) for reinforcing the heat exchange core (2*c*); a second heat exchanger (3) arranged in parallel to the first heat exchanger (2) in the air flow direction, having a heat exchange core (3*c*) including a plurality of tubes (3*a*) through which a fluid flows and fins (3*b*) provided on the outer surfaces of the tubes (3*a*), and reinforcement plates (3*d*) for reinforcing the heat exchange core (3*c*); and fastening means (5*b*) for mechanically coupling both the reinforcement plates (2*d*, 3*d*) of the first heat exchanger (2) and the reinforcement plates (3*d*) of the second heat exchanger (3) in a state in which the reinforcement plates (2*d*) are to next to, and overlap each other, in series in the air flow direction.

Due to this, as the distance between the heat exchange core (2*c*) of the first heat exchanger (2) and the heat exchange core (3*c*) of the second heat exchanger (3) becomes smaller than the distance between the cores of the multiple heat exchanger under examination, it is possible for the multiple heat exchanger according to the present invention to supply air for heat exchange to the heat exchanger arranged at the downstream side, at a flow-rate higher than that in the multiple heat exchanger under examination.

In a second aspect according to the present invention, both the reinforcement plates (2*d*, 3*d*) which have wall surfaces (2*e*, 3*e*) in opposition to each other in an air flow direction and the cross sections of which are formed substantially into a laid-down U-shape, are coupled by the fastening means (5*b*) in a state in which the wall surfaces (2*e*, 3*e*) are to next to, and overlap, each other in series in the air flow direction.

In a third aspect according to the present invention, the fastening means are bolts (5) penetrating through the wall surfaces (2*e*, 3*e*).

In a fourth aspect according to the present invention, the fastening means are rivets (5*b*) penetrating through the wall surfaces (2*e*, 3*e*).

A multiple heat exchanger according to a fifth aspect of the present invention comprises: a first heat exchanger (502) having a first heat exchange core (502*a*) including a plurality of tubes (502*b*) through which a fluid flows and fins (502*c*) provided on outer surfaces of the tubes, a first side plate (521) provided on a first engagement surface (520) formed in a direction of thickness of the first heat exchange core, and a first engagement plate (522) formed at a distance of a space (523) from the first engagement surface, one end of which is fixed on the first side plate via a connection part (524), and between the other end of which and the first engagement surface, an opening (525) is formed; and a second heat exchanger (503) having a second heat exchange core (503*a*) including a plurality of tubes (503*b*) through which a fluid flows and fins (503*c*) provided on outer surfaces of the tubes, a second side plate (531) provided on a second engagement surface (530) formed in a direction of thickness of the second heat exchange core, and a second engagement plate (532) formed at a distance of a space (533) from the second engagement surface, one end of which is fixed on the second side plate via a connection part (534), and between the other end of which and the second engagement surface, an opening (535) is formed. The first heat exchanger and the second heat exchanger are assembled so that the first engagement plate is located in the space between the second engagement plate and the second engagement surface, and the second engagement plate is located in the space between the first engagement plate and the first engagement surface.

In this invention, a side surface formed along the direction of thickness of the first heat exchange core is referred to as the first engagement surface, and the first engagement surface is provided with the first side plate. The first engagement plate is provided on the first side plate at a predetermined distance from the first engagement surface in such a manner that one end thereof is fixed on the first side plate via the connection part and the opening is formed between the other end thereof and the first engagement surface. The second heat exchange core is also provided with the second engagement plate like the first heat exchange core provided with the first engagement plate. Then, the first and second heat exchangers are assembled in such a manner that the first engagement plate is located in the space between the second engagement plate and the second engagement surface, and the second engagement plate is located in the space between the first engagement plate and the first engagement surface.

Due to this, a multiple heat exchanger can be configured so as to have a coupled state in which the movement thereof is prevented in at least a perpendicular direction with respect to the first and second engagement surfaces. Moreover, the multiple heat exchanger can be configured so as to have a coupled state in which the movement of the first engagement plate is prevented by the connection part of the second side plate, and the movement of the second engagement plate is prevented by the connection part of the first side plate.

Further, as the size of a space between each engagement plate and its corresponding engagement surface can be made substantially the same as the thickness of the other engagement plate, the distance between the first engagement surface and the second engagement surface can be limited to as small as a few times the thickness of the side plate or the engagement plate.

Still further, the first and second heat exchangers can be assembled easily by sliding one engagement plate into the space between the other engagement plate and its corresponding engagement surface to place the engagement plate in the space.

As described in a sixth aspect of the present invention, when the first engagement plate is arranged in parallel to the first engagement surface and the second engagement plate is arranged in parallel to the second engagement surface, the number of sliding directions at the time of assembling of the first and second heat exchangers can be two or more in a plane parallel to the first and the second engagement surfaces, so that the number of degrees of freedom in the sliding direction at the time of assembling can be increased.

In a seventh aspect according to the present invention, the size of the space between the first engagement plate and the first engagement surface is made substantially equal to the thickness of the second engagement plate, and the size of the space between the second engagement plate and the second engagement surface is made substantially equal to the thickness of the first engagement plate.

Due to this, at the time of assembling, the second engagement plate can be contained in the space between the first engagement plate and the first engagement surface, and the first engagement plate can be contained in the space between the second engagement plate and the second engagement surface. Therefore, the distance between the first engagement surface and the second engagement surface after assembling can be limited to as small as the sum of the thickness of the first engagement plate and the thickness of the second engagement plate.

In an eighth aspect according to the present invention, the first engagement plate has a stop part (537*b*) at the end thereof in a direction of width perpendicular to the direction of thickness of the first heat exchange core, and the stop part is formed by extending the end in a direction toward the first side plate.

Due to this, the movement of the second engagement plate contained in the space between the first engagement plate and the first engagement surface, in other words, the movement of the second side plate fixed on the second engagement plate via the connection part can be prevented by the stop part provided at the end of the first engagement plate. Therefore, in the coupled state of the first heat exchanger and the second heat exchanger, movement in two directions perpendicular and parallel to the first and the second engagement surfaces can be prevented.

In a ninth aspect according to the present invention, the first side plate has a stop part (537*b*) at the end thereof in the direction of width perpendicular to the direction of thickness of the first heat exchange core, and the stop part is formed by extending the end in the direction toward the first engagement plate.

Due to this, the movement of the second engagement plate contained in the space between the first engagement plate and the first engagement surface, in other words, the movement of the second side plate fixed on the second engagement plate via the connection part can be prevented by the stop part provided at the end of the first side plate. Therefore, in the coupled state of the first heat exchanger and the second heat exchanger movement in two directions perpendicular and parallel to the first and the second engagement surfaces can be prevented.

In a tenth aspect according to the present invention, the first side plate has a stop part (536*b*) at an end thereof near the opening in a direction of thickness of the first heat exchange core, and the stop part is formed by extending the end in a direction toward the first engagement plate.

Due to this, the movement of the second engagement plate contained in the space between the first engagement plate and the first engagement surface, in other words, the movement of the second side plate fixed on the second engagement plate via the connection part can be prevented by the stop part provided at the end of the first side plate. Therefore, in the coupled state of the first heat exchanger and the second heat exchanger movement in two directions perpendicular and parallel to the first and the second engagement surfaces can be prevented.

In an eleventh aspect according to the present invention, the first engagement plate has insertion protrusions (540*a*) facing the first side plate and the second engagement plate has insertion recesses (540*b*) facing the second side plate, and the insertion protrusions are inserted into the insertion recesses.

Due to this, the relative movement of the first heat exchanger and the second heat exchanger in the planes of the first engagement plate and the second engagement plate can be prevented.

A multiple heat exchanger according to the invention described in claim 12 comprises a join part (539) at which an end of the first side plate and at least one of the end of the second side plate and the connection part of the second side plate are joined.

According to this invention, the end of the first side plate and at least one of the end of the second side plate and the connection part of the second side plate with the second engagement plate are joined at the join part. Here, to "join" means to fix firmly two members on each other by means of welding such as laser welding, arc welding, and spot welding, or by means of adhesion using an adhesive. Also, the join part can be provided on the first and second side plates or on part of the connection part thereof. Therefore, the relative movement of the first heat exchanger and the second heat exchanger can be prevented by the join part.

As described in a thirteenth aspect of the present invention, the relative movement of the first heat exchanger and the second heat exchanger can also be prevented by providing the join part (539) at which the end of the first engagement plate and the end of at least one of the second engagement plate and the second side plate are joined.

A multiple heat exchanger according to a fourteenth aspect of the present invention comprises: the first heat exchanger (502) having the first heat exchange core (502*a*) including a plurality of the tubes (502*b*) through which a fluid flows and the fins (502*c*) provided on outer surfaces of the tubes and the first side plate (521) provided on the first engagement surface (520) of the first heat exchange core formed in an air flow direction and on which a first engagement part having a laid-down U-shaped transverse section with respect to a direction perpendicular to the air flow direction is formed; and the second heat exchanger (503) having the second heat exchange core (503*a*) including a plurality of the tubes (503*b*) through which a fluid flows and the fins (503*c*) provided on outer surfaces of the tubes and the second side plate (531) provided on the second engagement surface (530) of the second heat exchange core formed in an air flow direction and on which a second engagement part having a laid-down U-shaped transverse section with respect to a direction perpendicular to the air flow direction is formed. The first heat exchanger and the second heat exchanger are joined by means of the engagement between the first engagement part and the second engagement part by sliding the first engagement part and the second engagement part toward each other in a plane formed in the air flow direction.

In this invention, a side formed along the air flow direction of the first heat exchange core is referred to as the first engagement surface and the side plate is provided on the first engagement surface. On the first side plate, the first engagement part having a laid-down U-shaped transverse section with respect to the direction perpendicular to the air flow direction of the first heat exchange core is formed. The second exchange core is also provided with the second engagement part having a laid-down U-shaped transverse section with respect to the air flow direction of the second hear exchange core, in a manner similar to that of the first engagement part of the first heat exchange core. Then, the first and the second heat exchangers are assembled by sliding the first engagement part and the second engagement part in a state in which the respective laid-down U-shaped openings face each other in a plane in the air flow direction.

Due to this, a multiple heat exchanger can be configured so as to have a coupled state in which movement is prevented in the perpendicular direction with respect to at least the first and the second engagement surfaces. Moreover, in the air flow direction of the first and second engagement surfaces, the multiple heat exchanger can be coupled in a state in which the relative movement of the first engagement part and the second engagement part in the sliding direction at the time of assembling can be prevented.

Also, the distance between the first engagement surface and the second engagement surface can be made small. Further, the first and the second heat exchangers can be assembled easily by sliding and placing one engagement plate into the space between the other engagement plate and its corresponding engagement surface.

A multiple heat exchanger according to a fifth aspect of the present invention comprises: a first heat exchange core (702*c*) having a plurality of tubes (702*a*) through which a fluid flows and fins (702*b*) provided on outer surfaces of the tubes (702*a*); first reinforcement plates (702*d*) arranged at ends of the first heat exchange core (702*c*) to reinforce the first heat exchange core (702*c*), having two wall surfaces (702*e*) in opposition to each other in an air flow direction, and the sections of which are formed substantially into a laid-down U-shape; a second heat exchange core (703*c*) having a plurality of tubes (703*a*) through which a fluid flows and fins (703*b*) provided on outer surfaces of the tubes (703*a*); second reinforcement plates (703*d*) arranged at ends of the second heat exchange core (703*c*) to reinforce the second heat exchange core (703*c*), having two wall surfaces (703*e*) in opposition to each other in the air flow direction, and the section of which are formed substantially into a laid-down U-shape; and a coupling member (705) arranged between the two wall surfaces (702*e*) of the first reinforcement plates (702*d*) and between the two wall surfaces (703*e*) of the second reinforcement plates (703*d*) and coupling the first reinforcement plates (702*d*) and the second reinforcement plates (703*d*).

Due to this, as the maximum width of the multiple heat exchanger coincides with the width of the first reinforcement plate (702*d*) and the second reinforcement plate (703*d*), the maximum width of the multiple heat exchanger can be prevented from exceeding the width of the first heat exchange core (702*c*) or the width of the second heat exchange core (703*c*).

In a sixteenth aspect according to the present invention, the coupling member (705) and the first reinforcement plate (703*d*) are engaged by inserting insertion projections (705*d*) formed on at least one of the coupling member (705) and the first reinforcement plate (702*d*) into insertion holes (702*h*) formed in the other, that is, the coupling member (705) or the first reinforcement plate (702*d*) on which the insertion projections (705*d*) are not formed.

In a seventeenth aspect according to the present invention, the coupling member (705) and the second reinforcement plate (703*d*) are engaged by inserting insertion projections (705*e*) formed on at least one of the coupling member (705) and the second reinforcement plate (703*d*) into insertion holes (703*h*) formed in the other, that is, the coupling member (705) or the second reinforcement plate (703*d*) on which the insertion projections (705*e*) are not formed.

In an eighteenth aspect according to the present invention, the insertion parts of the insertion projections (705*d*, 705*e*) and the insertion holes (702*h*, 703*h*) are filled with an adhesive or a hardening agent.

Due to this, the insertion projections (705*d*, 705*e*) and the insertions holes (702*h*, 703*h*) can be engaged with each other firmly.

In a nineteenth aspect according to the present invention, the coupling member (705) and the first reinforcement plate (702*d*) are fixed on each other by caulking by plastically deforming at least a part of the first reinforcement plate (702*d*) toward the coupling member (705).

Due to this, the coupling member (705) and the first reinforcement plate (702*d*) can be fixed firmly.

In a twentieth aspect according to the present invention, the coupling member (705) and the second reinforcement plate (703*d*) are fixed on each other by caulking by plastically deforming at least a part of the second reinforcement plate (702*d*) toward the coupling member (705).

Due to this, the coupling member (705) and the second reinforcement plate (702*d*) can be fixed on each other firmly.

In a twenty-first aspect according to the present invention, the coupling member (705) is made of a metal or a resin.

In a twenty-second aspect according to the present invention, the coupling member (705) is made of an elastically deformable material.

Due to this, the coupling member (705) can absorb vibrations.

In a twenty-third aspect according to the present invention, the coupling part of the coupling member with the first reinforcement plate (702*d*) and the second reinforcement plate (703*d*) is provided with reinforcement members (705*c*) to prevent the coupling member (705) from being deformed.

Due to this, the coupling between the coupling member (705), and the first reinforcement plate (702*d*) and between the coupling member (705) and the second reinforcement plate (703*d*) can be prevented, in advance, from being broken.

According to a twenty-fourth aspect of the present invention, heat exchangers of different sizes in the air flow direction and having reinforcement members of different widths can be coupled using coupling members in a simplified structure.

The symbols in the parentheses attached to each means are examples showing the correspondence with the specific means described in the later embodiments.

The present invention may be more fully understood from the description of the preferred embodiments of the invention set forth below, together with the accompanying drawings.

DESCRIPTION OF THE PREFERRED EMBODIMENTS (First Embodiment)

Figure 1:
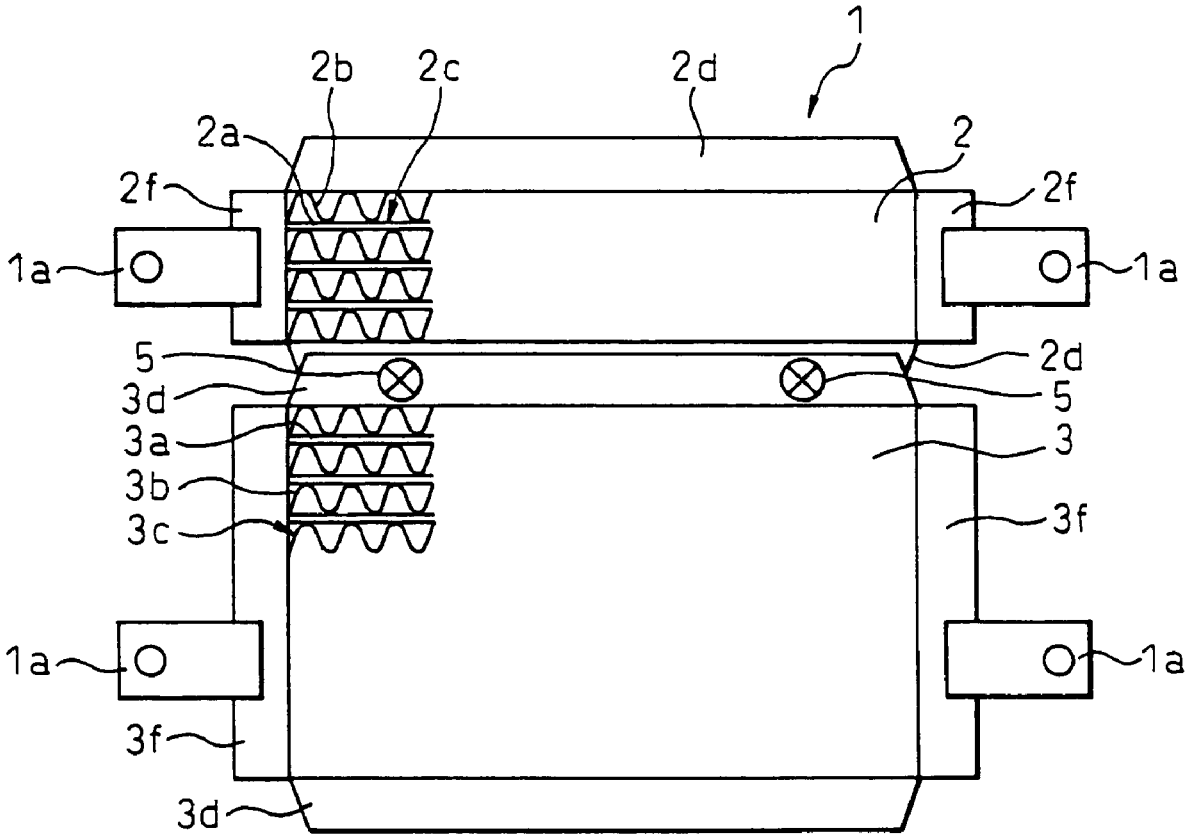
FIG. 1 is a front view of a multiple heat exchanger according to a first embodiment of the present invention when viewed in the air flow direction.
Figure 2:
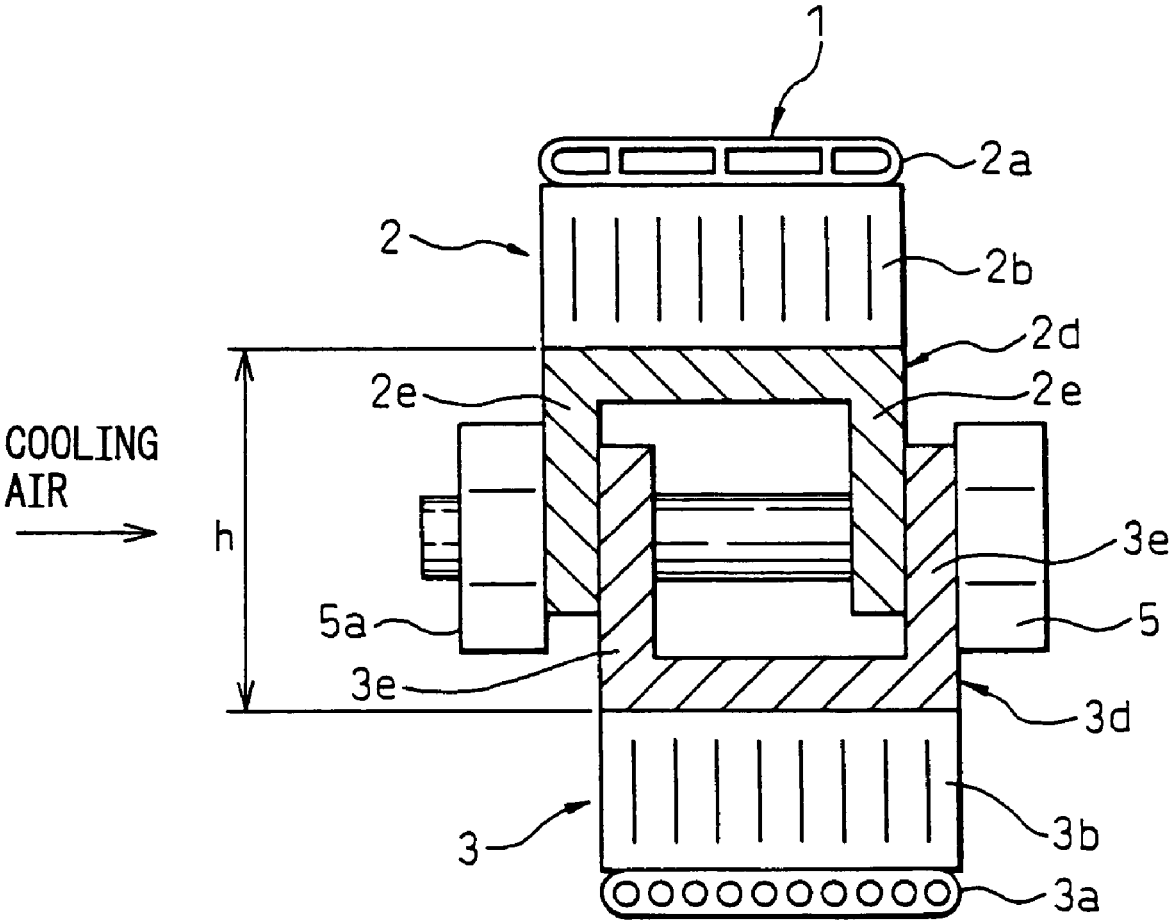
FIG. 2 is a diagram showing the characteristics of the multiple heat exchanger according to the first embodiment of the present invention.

In a first embodiment, a multiple heat exchanger (heat exchanger module) according to the present invention is applied to a cooling device for a hybrid vehicle. FIG. 1 is a diagram showing the characteristics of a multiple heat exchanger 1 according to the present embodiment, FIG. 2 is a front view of the multiple heat exchanger 1 when viewed in the air flow direction, and FIG. 3 is a diagram showing a state in which the multiple heat exchanger 1 according to the present embodiment is mounted on a vehicle.

As shown in FIG. 1, the multiple heat exchanger 1 according to the present embodiment comprises: a first radiator 2 that effects heat exchange between inverter cooling water and air, which water cools an electric motor for running a vehicle (not shown) and drive circuits such as an inverter circuit for controlling a drive current to the electric motor; an outdoor heat exchanger 3 of an air conditioner for a vehicle (which is installed outside the vehicle compartment) (a vapor compression type refrigerator); etc.

The first radiator 2 and the outdoor heat exchanger 3 are arranged in parallel to each other in the cooling air flow direction and at the upstream side in the cooling air flow direction with respect to the a second radiator 4. In the present embodiment, the first radiator 2 is arranged above the outdoor heat exchanger 3.

Figure 3:
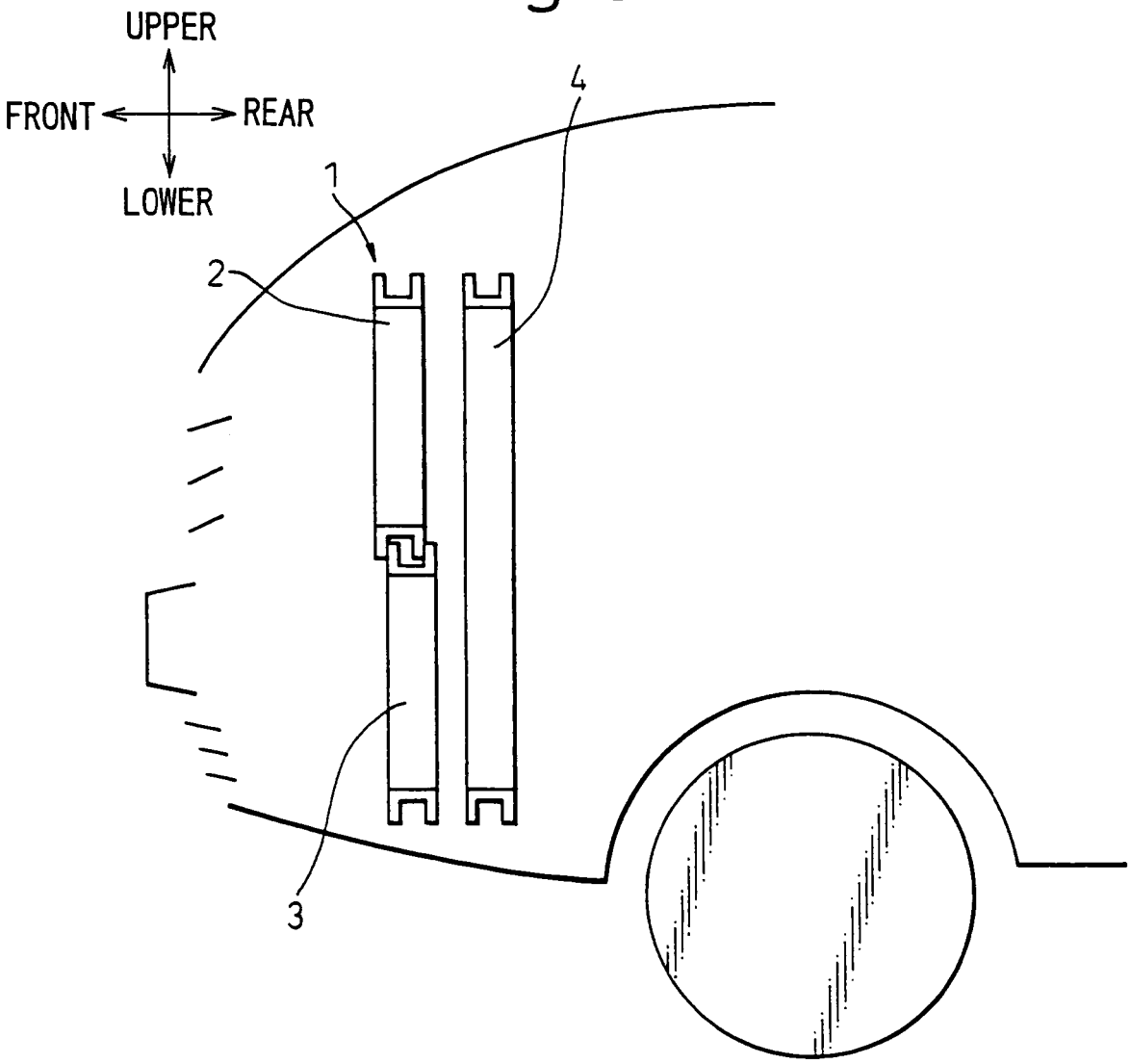
FIG. 3 is a diagram showing a state in which the multiple heat exchanger according to the first embodiment of the present invention is mounted on a vehicle.

As shown in FIG. 3, at the downstream side in the air flow direction of the multiple heat exchanger 1, that is, the first radiator 2 and the outdoor heat exchanger 3, the second radiator 4 is arranged that effects heat exchange between engine cooling water and air, which water cools an internal combustion engine for running a vehicle (not shown).

The first radiator 2 comprises, as shown in FIG. 1: a first heat exchange core 2*c* including flat tubes 2*a* through which inverter cooling water flows and fins 2*b* joined to the flat surfaces of the tubes 2*a*; header tanks 2*f* communicated with the plural tubes 2*a* at both ends of the tubes 2*a* in the longitudinal direction thereof; reinforcement plates 2*d* extending in parallel to the tubes 2*a* at the ends of the first heat exchange core 2*c* and reinforcing the first heat exchange core 2*c*; etc.

In the present embodiment, as shown in FIG. 2, the reinforcement plate 2*d* is formed by press molding so that the section thereof in parallel to the cooling air flow direction, that is, the longitudinal direction of a vehicle, is substantially in a laid-down U-shape that opens in the direction perpendicular to the cooling air flow direction, that is, in the vertical direction. At the same time, the tubes 2*a*, the fins 2*b*, the header tanks 2*f*, and the reinforcement plates 2*d* are all made of a metal such as an aluminum alloy and are integrally joined by brazing into one unit.

Here, the wording "brazing" refers to a joining technique using a brazing material or solder without melting a base metal, as described in "Connecting/Joining Technique" (Tokyo Denki University, Press Department).

Joining using a filler material having a melting point of 450° C. or higher is referred to as brazing and the filler material is called a brazing material and joining using a filler material having a melting point of 450° C. or lower is referred to as soldering and the filler material is called solder.

The second radiator 4 has a structure similar to that of the first radiator 2. To be specific, the second radiator 4 comprises: a heat exchange core including flat tubes (not shown) through which engine cooling water flows and fins (not shown) joined to the flat surfaces of the tubes; header tanks (not shown) communicated with the plural tubes at both ends of the tubes in the longitudinal direction thereof; reinforcement plates extending in parallel to the tubes 3*a* at the ends of the heat exchange core, reinforcing the heat exchange core, and having a laid-down U-shaped section; etc. In the present embodiment, the tubes, the fins, the header tanks, and the reinforcement plates are all made of a metal such as an aluminum alloy and are integrally joined by brazing into one unit.

The outdoor heat exchanger 3 has a structure similar to that of the first radiator 2. To be specific, the outdoor heat exchanger 3 comprises, as shown in FIG. 1: a second heat exchange core 3*c* including flat tubes 3*a* through which a refrigerant flows and fins 3*b* joined to the flat surfaces of the tubes 3*a*; header tanks 3*f* communicated with the plural tubes 3*a* at both ends of the tubes 3*a* in the longitudinal direction thereof; reinforcement plates 3*d* extending in parallel to the tubes 3*a* at the ends of the second heat exchange core 2*c*, reinforcing the second heat exchange core 3*c*, and having a laid-down U-shaped section; etc. In the present embodiment, the tubes 3*a*, the fins 3*b*, the header tanks 3*f*, and the reinforcement plates 3*d* are all made of a metal such as an aluminum alloy and are integrally joined by brazing into one unit.

In the present embodiment, the longitudinal direction of the tubes 2*a* and 3*a* is made to coincide with the horizontal direction and, at the same time, a wavy corrugated fin formed as a louver for increasing the heat transfer efficiency by disturbing the air flow is employed as the fins 2*b* and 3*b*.

Moreover, brackets 1*a* (refer to FIG. 1) are joined by brazing to the header tanks 2*f* and 3*f* in order to assemble the heat exchanger module 1 to a vehicle.

Wall surfaces 2*e* of the reinforcement plate 2*d* near the outdoor heat exchanger 3 and wall surfaces 3*e* of the reinforcement plate 3*d* near the first radiator 2, which are perpendicular to the cooling air flow direction, that is, the wall surfaces of the reinforcement plates 2*d* and 3*d* in opposition to each other are mechanically coupled with a bolt 5 penetrating through both the reinforcement plates 2*d* and 3*d* and a nut 5*a* in a state in which both come to next to and overlap each other in series in the cooling air flow direction, as shown in FIG. 2.

In the present embodiment, the wall surfaces 2*e* of the first radiator 2 and the wall surfaces 3*e* of the outdoor heat exchanger 3 come next to and overlap each other in series in the cooling air flow direction so that the wall surfaces 2*e* and 3*e* are positioned alternately in the cooling air flow direction, but the present invention is not limited to this arrangement, as will be described later.

Next, the function and effect of the present embodiment are described below.

In the present embodiment also, the space between the first heat exchange core 2*c* and the second heat exchange core 3*c* is blocked by the reinforcement plate 3*d* of the outdoor heat exchanger 3 and the reinforcement plate 2*d* of the first radiator 2. In the present embodiment, however, the reinforcement plate 3*d* of the outdoor heat exchanger 3 and the reinforcement plate 2*d* of the first radiator 2 are mechanically coupled with the bolt 5, which is a fastening means, in a state in which both come next to and overlap each other in series in the cooling air direction and, therefore, a distance h (refer to FIG. 2) between the first heat exchange core 2*c* and the second heat exchange core 3*c* becomes smaller than a distance h0 between the cores in the multiple heat exchanger 1 under examination, as shown in FIG. 4.

Because of this, it is possible for the multiple heat exchanger 1 according to the present invention to supply cooling air to the second radiator 4 arranged at the downstream side, at a flow-rate higher than that in the multiple heat exchanger 1 under examination.

FIG. 4(A) shows the multiple heat exchanger 1 according to the present embodiment and FIG. 4(B) shows the multiple heat exchanger 1 under examination.

Figure 4:
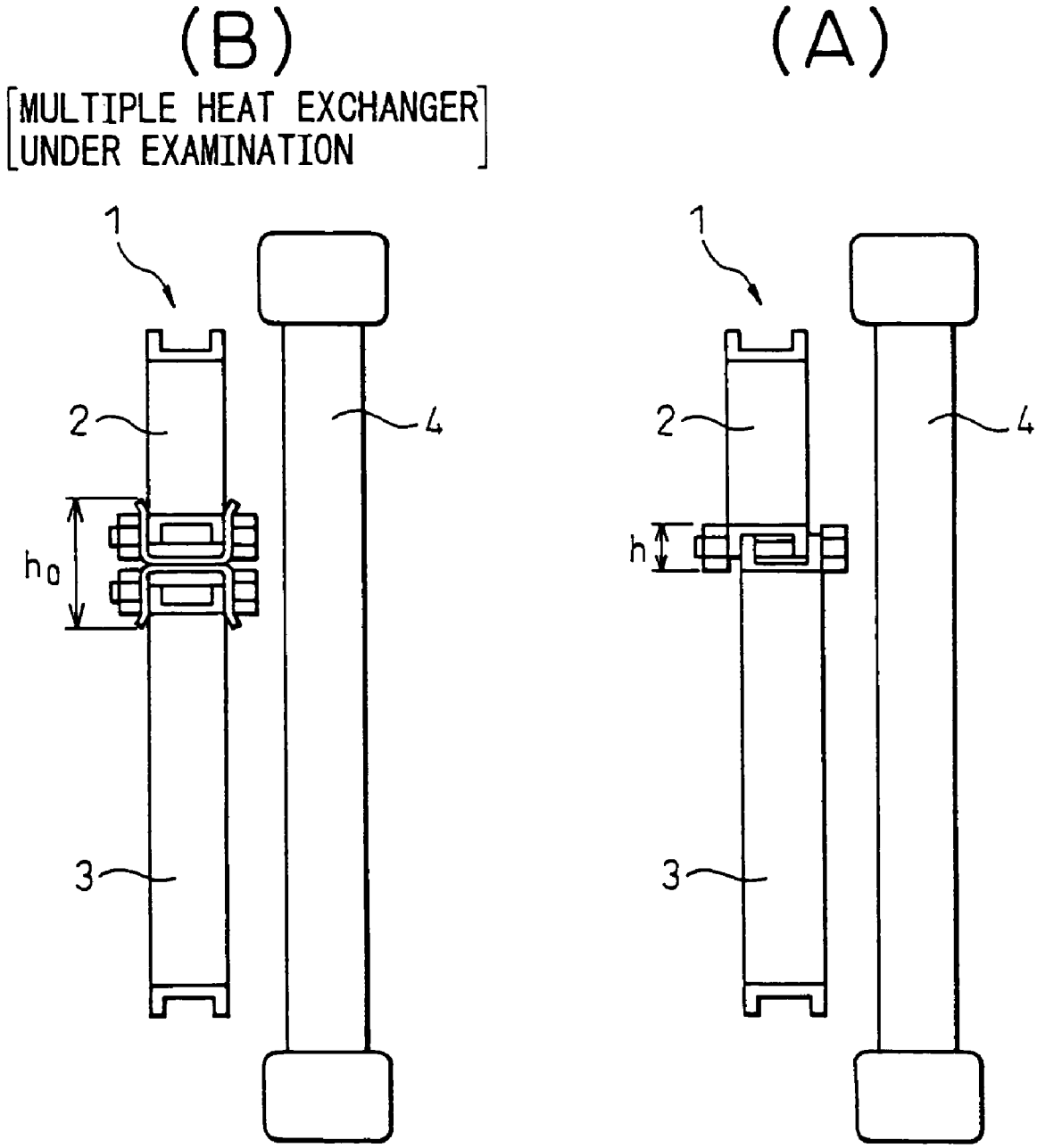
FIG. 4 is a diagram showing a multiple heat exchanger according to the present embodiment in (A) and a multiple heat exchanger under examination in (B).

In the present embodiment, as the distance h between the first heat exchange core 2*c* and the second heat exchange core 3*c* becomes smaller than the distance of that under examination, it is possible to enlarge both or either of the first heat exchange core 2*c* and the second heat exchange core 3*c* without increasing the outer dimensions of the multiple heat exchanger 1, as shown in FIG. 4.

Moreover, both of the reinforcement plates 2*d* and 3*d* are made to overlap each other in the cooling air flow direction so that the wall surfaces 2*e* and 3*e* of both the reinforcement plates 2*d* and 3*d* come into contact with each other and, therefore, the dimensions of a portion of the multiple heat exchanger 1 parallel to the cooling air flow direction can be reduced.

In the present embodiment, the reinforcement plate 3*d* of the outdoor heat exchanger 3 and the reinforcement plate 2*d* of the first radiator 2 are joined directly with the bolt 5, which is a fastening means and, therefore, brackets are not required unlike the multiple heat exchanger under examination. Due to this, the number of parts and the number of assembling processes can be reduced compared to the case of the heat exchanger under examination.

(Second Embodiment)

Figure 5:
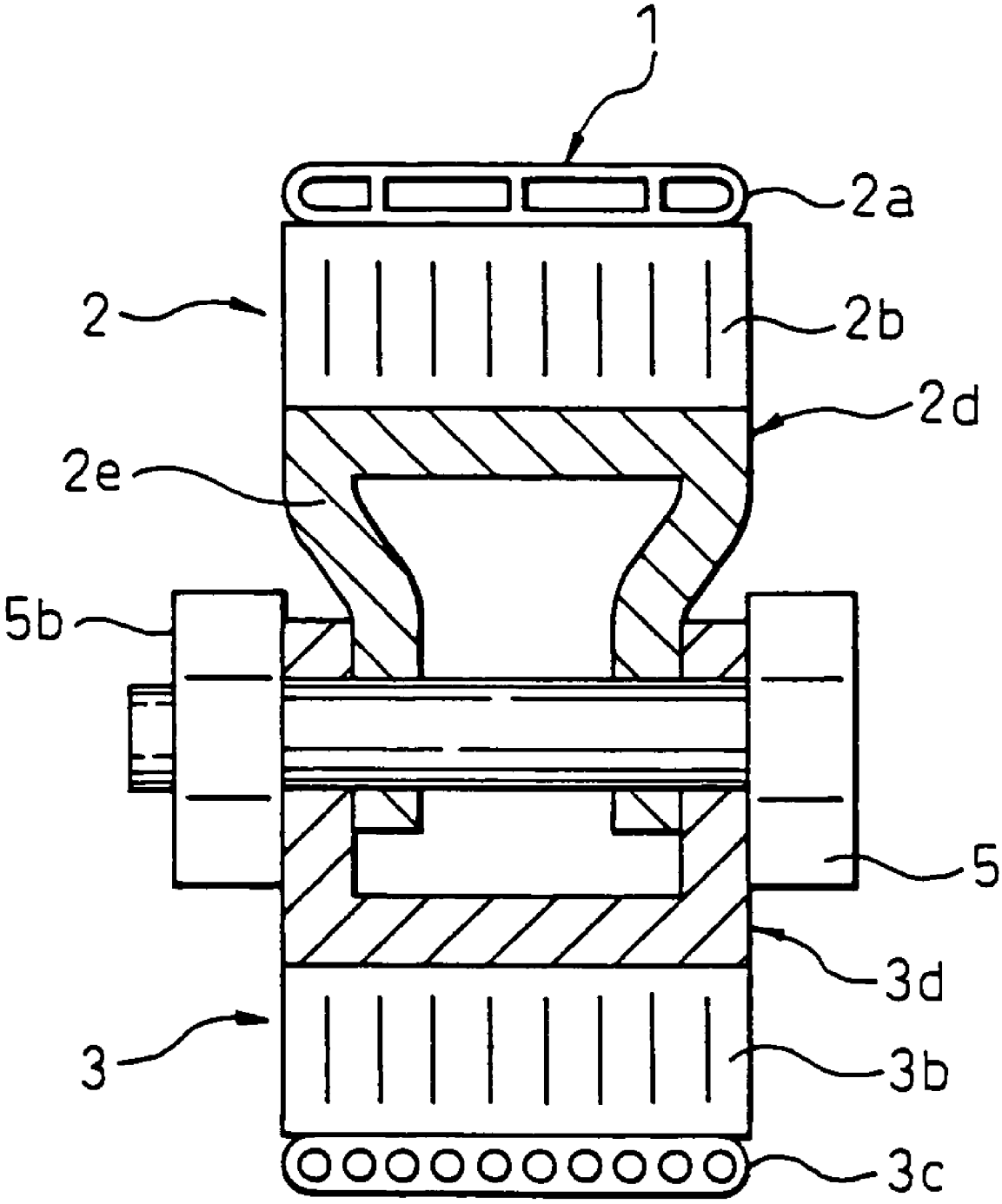
FIG. 5 is a diagram showing the characteristics of a multiple heat exchanger according to a second embodiment of the present invention.

In the first embodiment, the wall surfaces 2*e* of the first radiator 2 and the wall surfaces 3*e* of the outdoor heat exchanger 3 are made to come next to and overlap each other in series in the cooling air flow direction so as to be positioned alternately in the cooling air flow direction, but in the present embodiment, as shown in FIG. 5, both the reinforcement plates 2*d* and 3*d* are mechanically joined in a state of being made to come next and overlap each other in series in the air flow direction so that the reinforcement plate 2*d* of the first radiator 2 is accommodated within the reinforcement plate 3*d* of the outdoor heat exchanger 3.

(Third Embodiment)

Figure 6:
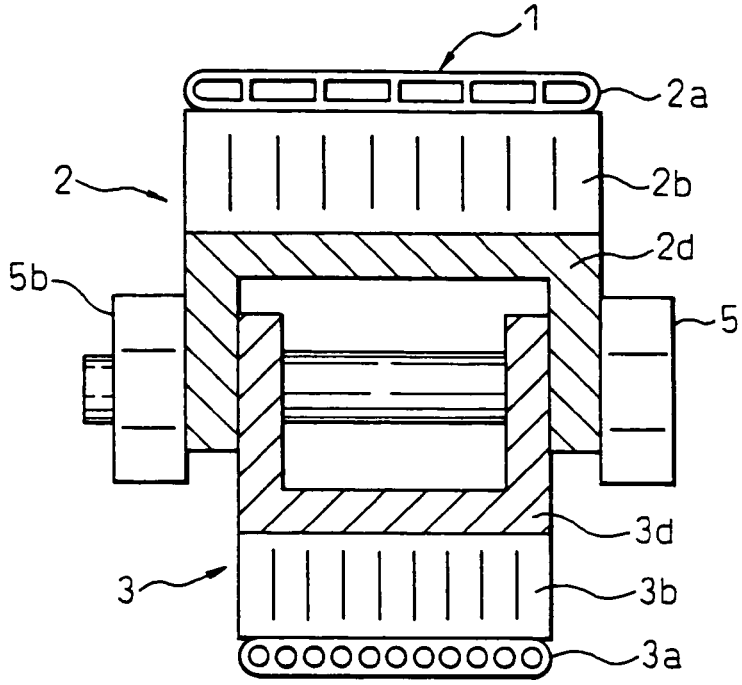
FIG. 6 is a diagram showing the characteristics of a multiple heat exchanger according to a third embodiment of the present invention.

In the second embodiment, both the reinforcement plates 2*d* and 3*d* are mechanically joined in a state of being next to and overlapping each other in series in the air flow direction so that the reinforcement plate 2*d* of the first radiator 2 is accommodated within the reinforcement plate 3*d* of the outdoor heat exchanger 3, but in the present embodiment, as shown in FIG. 6, both the reinforcement plates 2*d* and 3*d* are mechanically joined in a state of being made to come next to and overlap each other in series in the air flow direction so that the reinforcement plate 3*d* of the outdoor heat exchanger 3 is accommodated within the reinforcement plate 2*d* of the first radiator 2.

(Fourth Embodiment)

Figure 7:
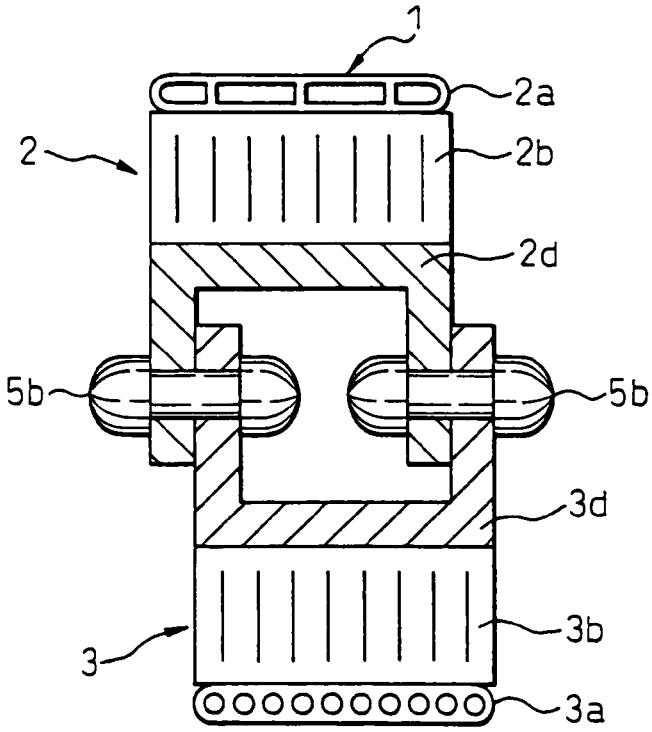
FIG. 7 is a diagram showing the characteristics of a multiple heat exchanger according to a fourth embodiment of the present invention.

In the above-mentioned embodiments, the bolt 5 is employed as a fastening means, but in the present embodiment, as shown in FIG. 7, a rivet 5*b* is employed as a fastening means.

FIG. 7 shows a case where the present embodiment is applied to the structure of the multiple heat exchanger 1 according to the first embodiment, but the present embodiment is not limited to that shown in FIG. 7 but may be applied to either of the multiple heat exchangers 1 according to the second and third embodiments.

(Fifth Embodiment)

Figure 8:
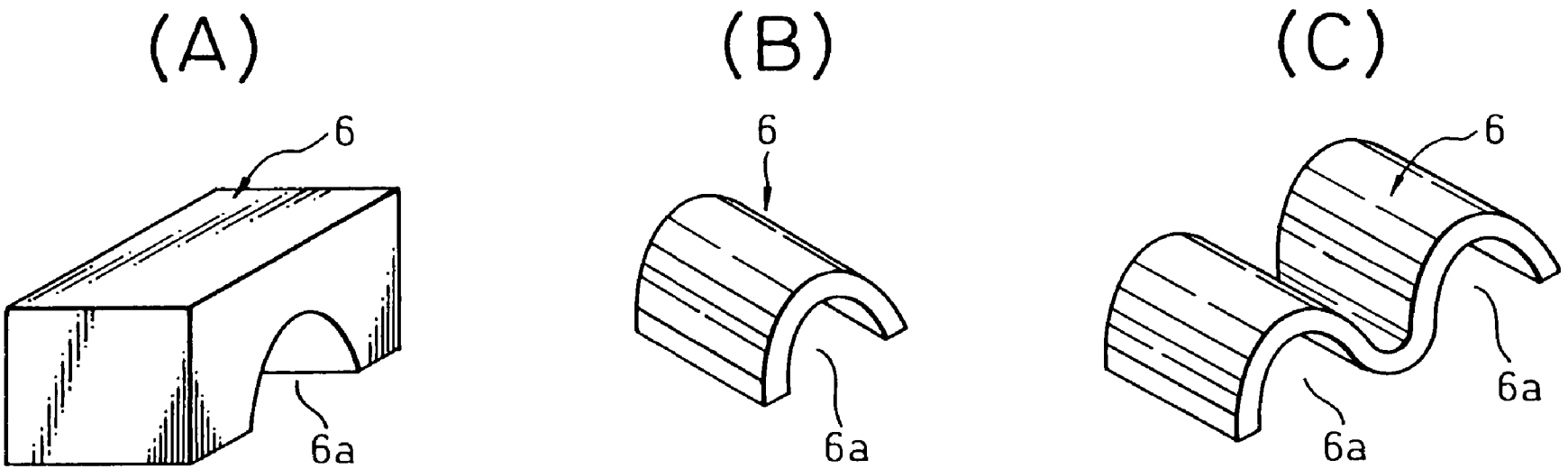
FIG. 8 is a diagram showing blocks according to a fifth embodiment of the present invention.

In the first to third embodiments, the bolt 5 penetrates through the reinforcement plates 2*d* and 3*d* and, therefore, there is a possibility that the reinforcement plates 2*d* and 3*d* may be crushed if the bolt 5 is tightened. In order to avoid this, in the present embodiment, the bolt 5 is tightened in a state in which blocks 6 shown in FIG. 8 are arranged between the wall surfaces 2*e* and 3*e* facing each other.

It is preferable that the blocks 6 be joined to the reinforcement plates 2*d* and 3*d* by brazing, respectively. The block 6 is provided with a recess 6a in order to avoid interference with the bolt 5.

(Sixth Embodiment)

Figure 9:
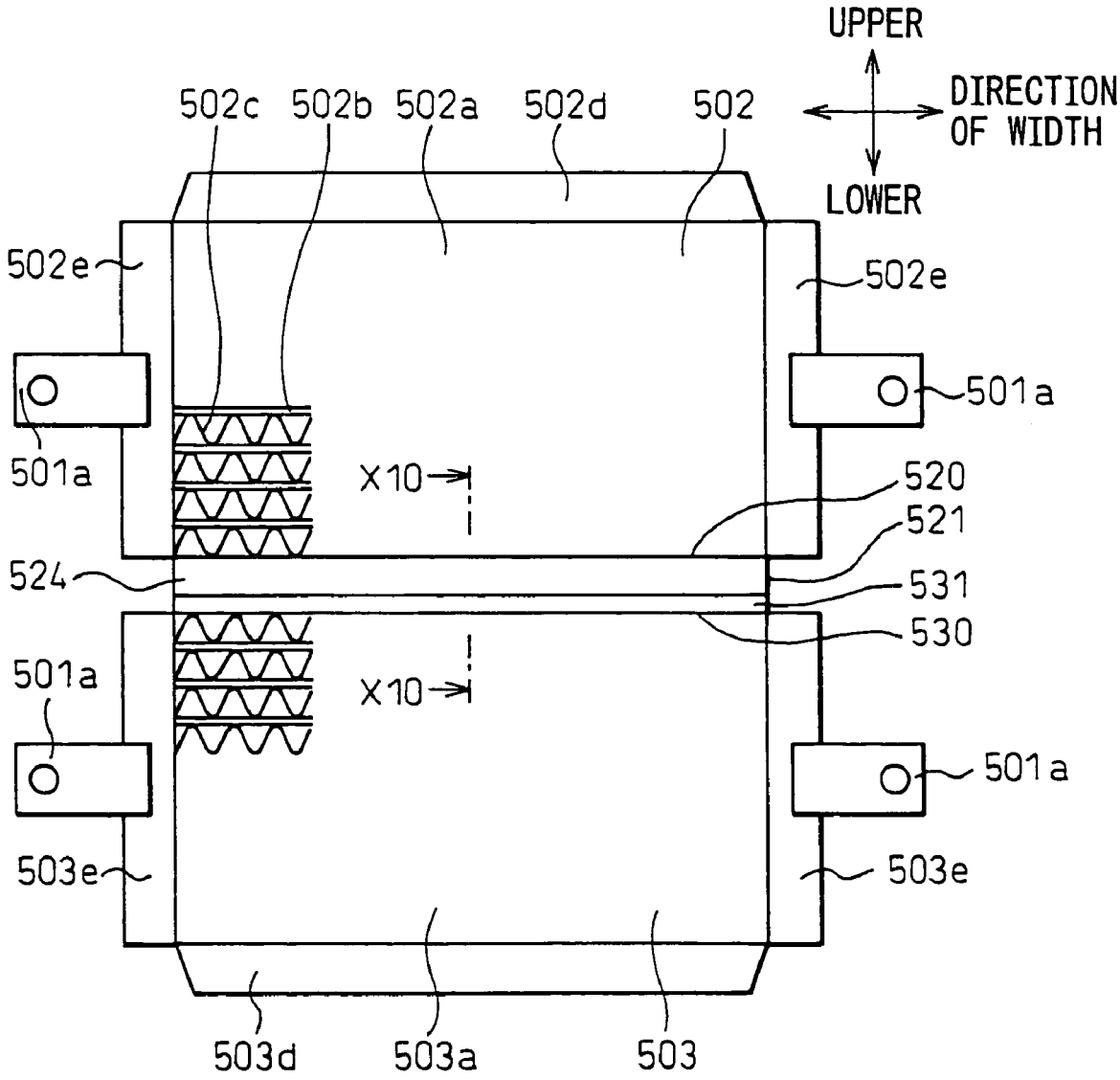
FIG. 9 is a front view of a multiple heat exchanger according to a sixth embodiment of the present invention when viewed in the air flow direction.
Figure 10:
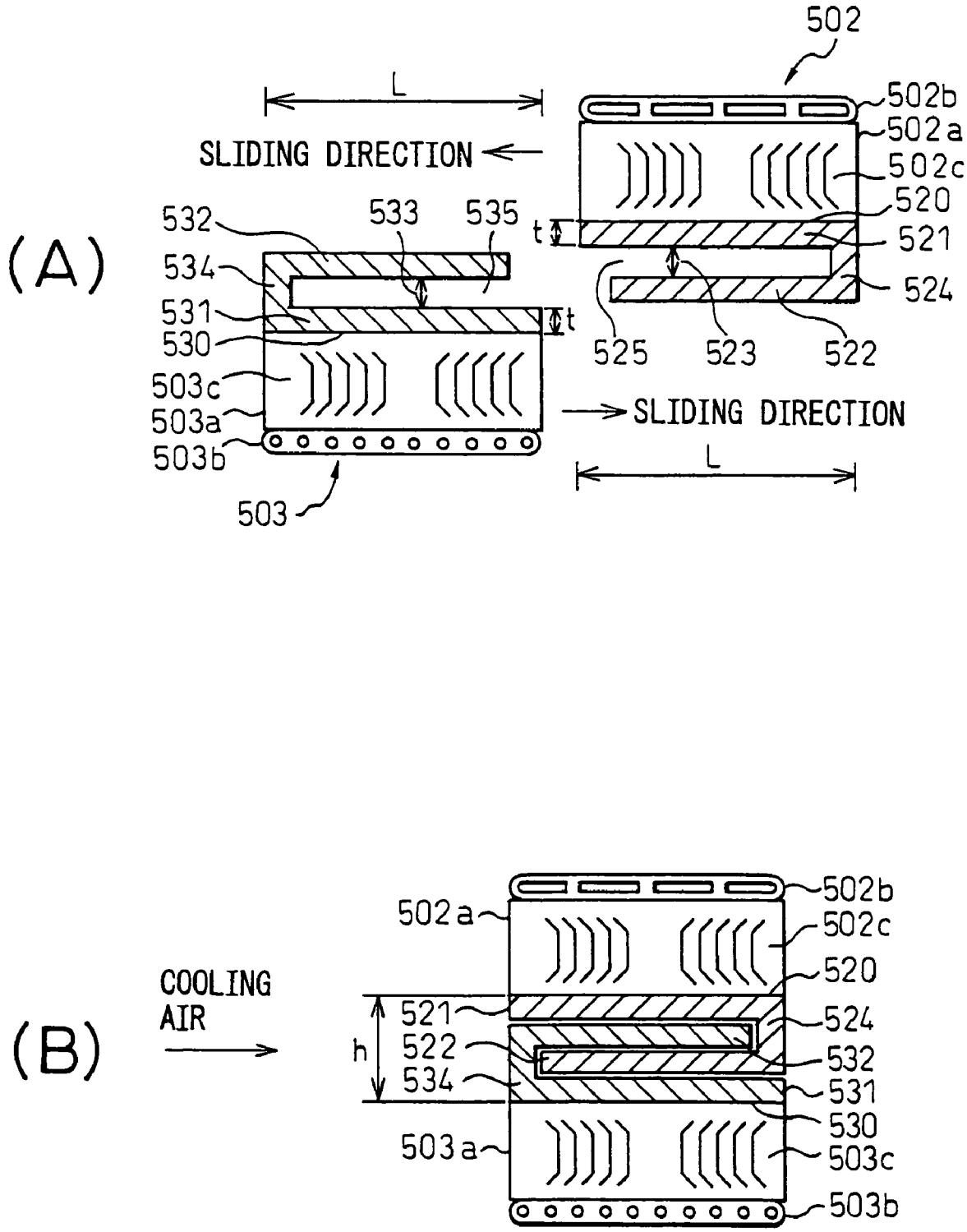
FIG. 10 is a sectional view showing the characteristics of the multiple heat exchanger in the sixth embodiment, in which (A) shows a state before assembling and (B) shows a state after assembling.
Figure 11:
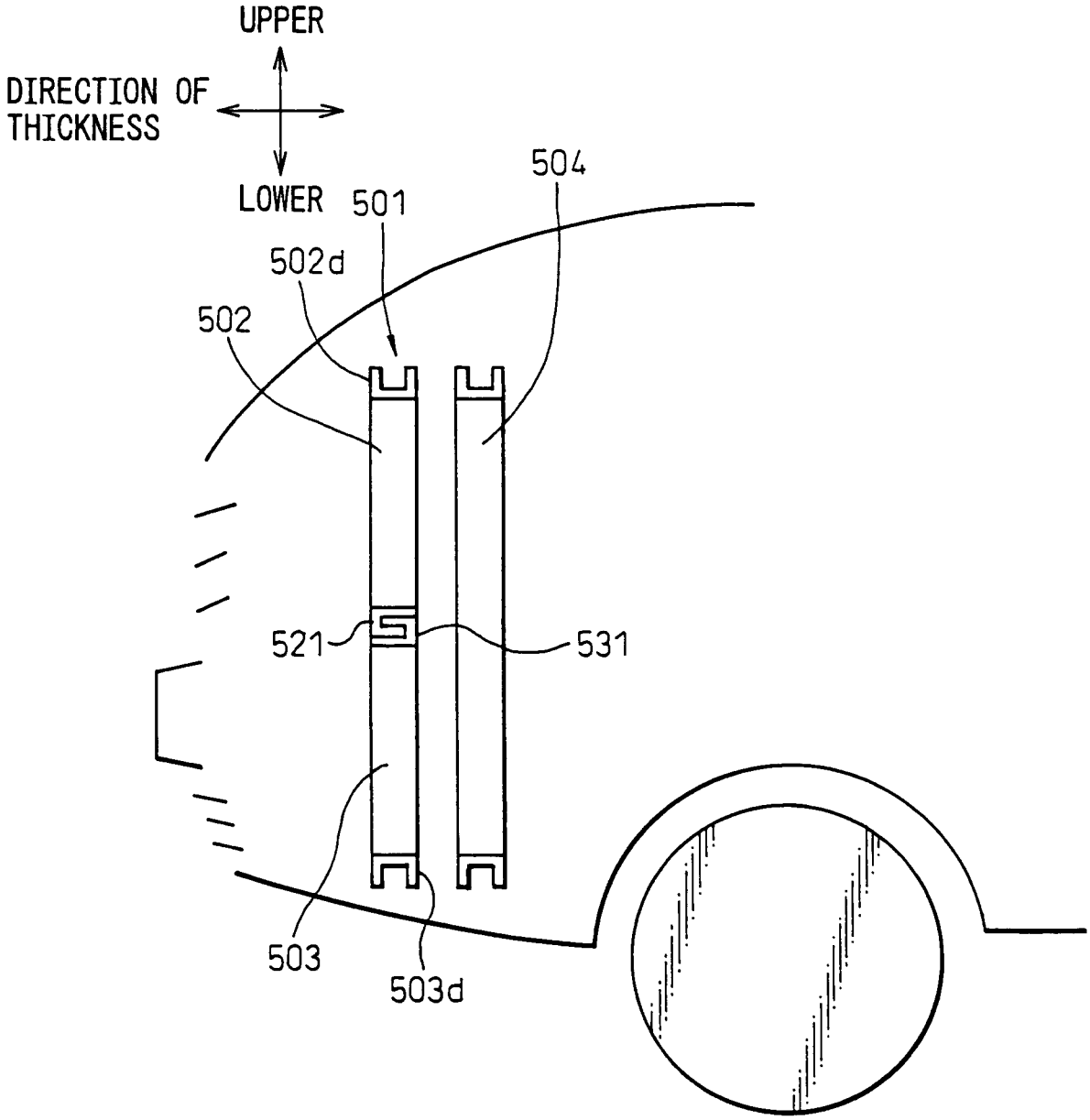
FIG. 11 is a diagram showing a state in which the multiple heat exchanger in the sixth embodiment is mounted on a vehicle.

In a sixth embodiment, the multiple heat exchanger according to the present invention is applied to a cooling device for a hybrid vehicle. FIG. 9 is a front view of a multiple heat exchanger 501 according to the sixth embodiment when viewed in the air flow direction and FIG. 10 is a diagram showing the section (the section along X10—X10 in FIG. 9) of a joined part of a first heat exchanger 502 and a second heat exchanger 503 of the multiple heat exchanger 501. FIG. 11 is a diagram showing a state in which the multiple heat exchanger 501 according to the sixth embodiment is mounted on a vehicle.

As shown in FIG. 9, the multiple heat exchanger 501 according to the sixth embodiment comprises: a first radiator 502 as the first heat exchanger that effects heat exchange between inverter cooling water and air, which water cools an electric motor for running a vehicle (not shown) and drive circuits such as an inverter circuit for controlling a drive current to the electric motor; an outdoor heat exchanger 503 as the second heat exchanger of an air conditioner for a vehicle (vapor compression type refrigerator); etc.

The first radiator 502 and the outdoor heat exchanger 503 are arranged in parallel to each other with respect to the cooling air flow direction at the upstream side of a second radiator 504 in the cooling air flow direction thereof which will be described later. In the present embodiment, the first radiator 502 is arranged above the outdoor heat exchanger 503.

At the downstream side in the cooling air flow direction of the multiple heat exchanger 501, that is, the first radiator 502 and the outdoor heat exchanger 503, as shown in FIG. 11, the second radiator 504 that effects heat exchange between engine cooling water and air is arranged, which cooling water cools an internal combustion engine for moving a vehicle (not shown).

The first radiator 502 comprises, as shown in FIG. 9: a first heat exchange core 502*a* including flat tubes 502*b* through which inverter cooling water flows and fins 502*c* joined to the flat surfaces of the tubes 502*b*; header tanks 502*e* communicated with the plural tubes 502*a* at both ends of the tubes 502*a* in the longitudinal direction thereof; a reinforcement plate 502*d* extending in parallel to the tubes 502*b* at the end of the first heat exchange core 502*a* and reinforcing the first heat exchange core 502*a*; and a first side plate 521.

The first side plate 521 is formed in advance by press molding from a metal plate made of an aluminum alloy having a plate thickness t (for example, t=approximately 1.6 mm) so that the section thereof in the direction of thickness of the first side plate 521 is substantially in a laid-down U-shape when arranged at the side of the first heat exchange core 502*a* in the direction of a thickness L (for example, L=approximately 22 mm), or in detail, at a first engagement surface 520, which is a side in parallel to the cooling air flow direction, that is, the longitudinal direction of a vehicle.

Due to the press molding, a space 523 having a size substantially the same as the plate thickness (for example, t=approximately 1.6 mm) of a second engagement plate 532 is formed between the first side plate 521 and a first engagement plate 522 and, at the same time, the first side plate 521 and the first engagement plate 522 are fastened (joined) to each other by a connection part 524 at one end side in the air flow direction and, thereby, an opening 525 is formed at the other end side in opposition to the connection part 524. The total thickness of the first side plate 521, the space 523, and the first engagement plate 522, that is, from the first engagement surface 520 to the bottom surface of the first engagement plate 522, is 3t (=approximately 4.8 mm).

Then, the first heat exchanger 502 is formed by integrally joining, by brazing into a unit, the first side plate 521 arranged on the first engagement surface 520, the tubes 502*b*, the fins 502*c*, the header tanks 502*e*, and the reinforcement plate 502*d* arranged on the side in the direction of thickness in opposition to the first engagement surface 520, as the last four components are made of a metal such as an aluminum alloy like the first side plate 521.

Figure 12:
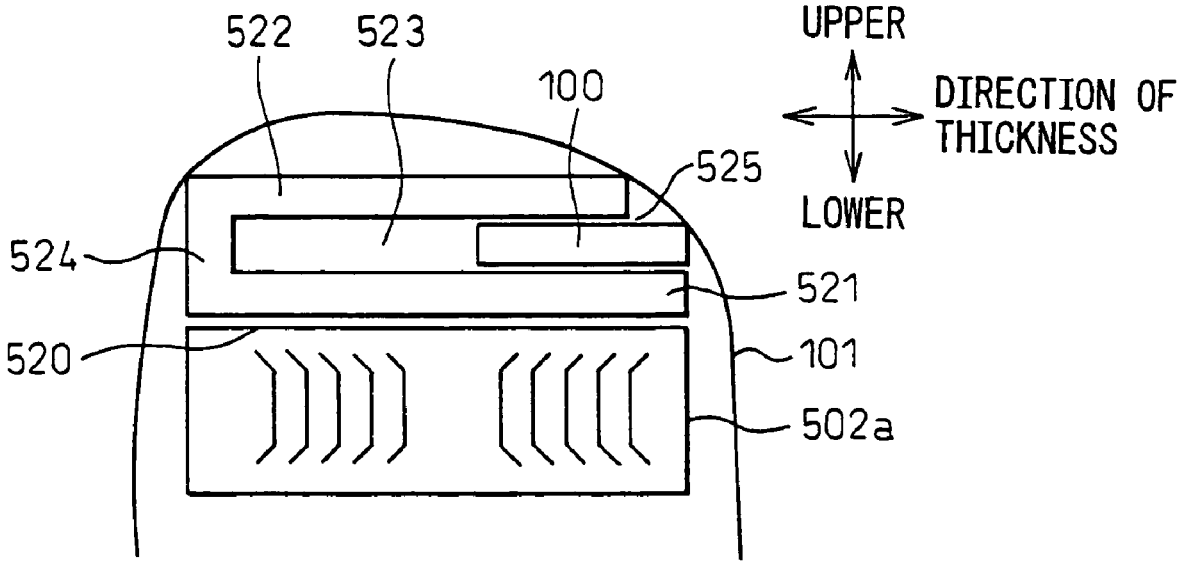
FIG. 12 is a diagram showing a state of a first heat exchanger in the sixth embodiment in a brazing process.

As shown in FIG. 12, the brazing process is performed in a state in which a spacer 100 is inserted into the space 523 from the opening 525 between the first side plate 521 and the first engagement plate 522, and the first side plate 521, the first heat exchange core 502*a*, and the reinforcement plate 502*d*, which is not shown in FIG. 12, are put together integrally with a fixing wire 101. Due to the space 100, the opening 525 and the space 523 on the first side plate 521 can be prevented from being deformed during the brazing process.

The outdoor heat exchanger 503 as the second heat exchanger has a structure similar to that of the first radiator 502 as the first heat exchanger. To be specific, the outdoor heat exchanger 503 comprises, as shown in FIG. 9: a second heat exchange core 503*a* including flat tubes 503*b* through which a refrigerant flows and fins 503*c* joined to the flat surfaces of the tubes 503*b*; header tanks 503*e* communicated with the plural tubes 503*b* at both ends of the tubes 503*b* in the longitudinal direction thereof; a reinforcement plate

503*d* extending in parallel to the tubes 503*b* at the end of the second heat exchange core 503*a*, reinforcing the second heat exchange core 503, and having a laid-down U shaped section; and a second side plate 531.

The second side plate 531 is formed in advance by press molding from a metal plate made of an aluminum alloy having the plate thickness t (for example, t=approximately 1.6 mm) so that, as shown in FIG. 10, the section thereof in the direction of thickness of the second side plate 531 is substantially in a laid-down U-shape when arranged at the side of the second heat exchange core 503*a* in the direction of the thickness L (for example, L=approximately 22 mm), or in detail, at a second engagement surface 530, which is a side in parallel to the cooling air flow direction, that is, the longitudinal direction of a vehicle.

Due to the press molding, a space 533 having a size substantially the same as the plate thickness (for example, t=approximately 1.6 mm) of a first engagement plate 522 is formed between the second side plate 531 and the second engagement plate 532 and, at the same time, the second side plate 531 and the second engagement plate 532 are fastened (joined) to each other via a connection part 534 at one end side in the air flow direction and, thereby, an opening 535 is formed at the other end side in opposition to the connection part 534. The total thickness of the second side plate 531, the space 533, and the second engagement plate 532, that is, from the second engagement surface 530 to the top surface of the second engagement plate 532, is 3t (=approximately 4.8 mm).

Then, the second side plate 531 arranged on the second engagement surface 530, the tubes 503*b*, the fins 503*c*, the header tanks 503*e*, and the reinforcement plate 503*d* are integrally joined by brazing into a single metallic product made of an aluminum alloy, etc, as the last four components are made of a metal such as an aluminum alloy like the second side plate 531.

In the present embodiment, the longitudinal direction of the tubes 502*b* and 503*b* is made to coincide with the horizontal direction and, at the same time, a wavy corrugated fin formed as a louver for increasing the heat transfer efficiency by disturbing air flow is employed as the fins 502*c* and 503*c*.

The first radiator 502 and the outdoor heat exchanger 503 thus configured are assembled so that the first engagement surface 520 and the second engagement surface 530 are in opposition to each other, that is, the second engagement plate 532 having the thickness t is located within the space 523 having the size t between the first side plate 521 and the first engagement plate 522, and so that the first engagement plate 522 having the thickness t is located within the space 533 having the size t between the second side plate 531 and the second engagement plate 532.

The above-mentioned assembling is performed in such a manner that the opening 525 between the first side plate 521 and the first engagement plate 522 and the opening 535 between the second side plate 531 and the second engagement plate 532 are placed in opposition to each other and the first radiator 502 and the outdoor heat exchanger 503 are slid in parallel to the first engagement surface 520 and the second engagement surface 530 and in the direction in which both come closer to each other.

In other words, if it is assumed that the connection part 524 that connects the first side plate 521 and the first engagement plate 522 is referred to as a first engagement part and the connection part 534 that connects the second side plate 531 and the second engagement plate 532 is referred to as a second engagement part, the first radiator 502 as the first heat exchanger and the outdoor heat exchanger 503 as the second heat exchanger are joined by means of engagement of the first engagement part and the second engagement part, in the present embodiment.

Figure 13:
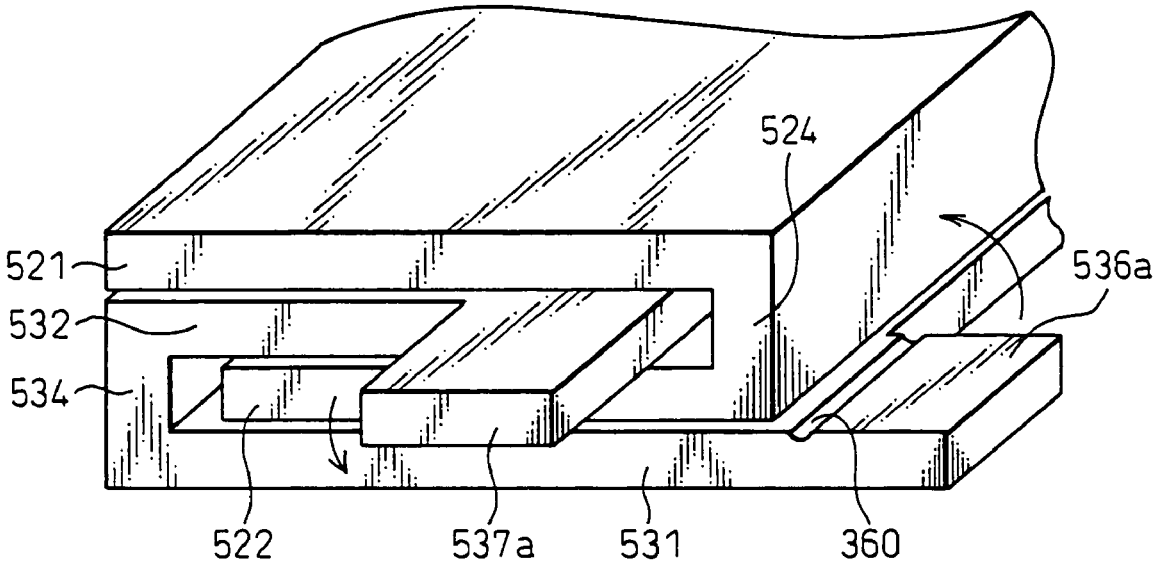
FIG. 13 is a perspective view showing a process of forming stop parts in the sixth embodiment, in which (A) is a diagram showing a state before protruding plates are bent and (B) is a diagram showing a state in which the protruding plates are bent and the stop parts are formed.
Figure 13:
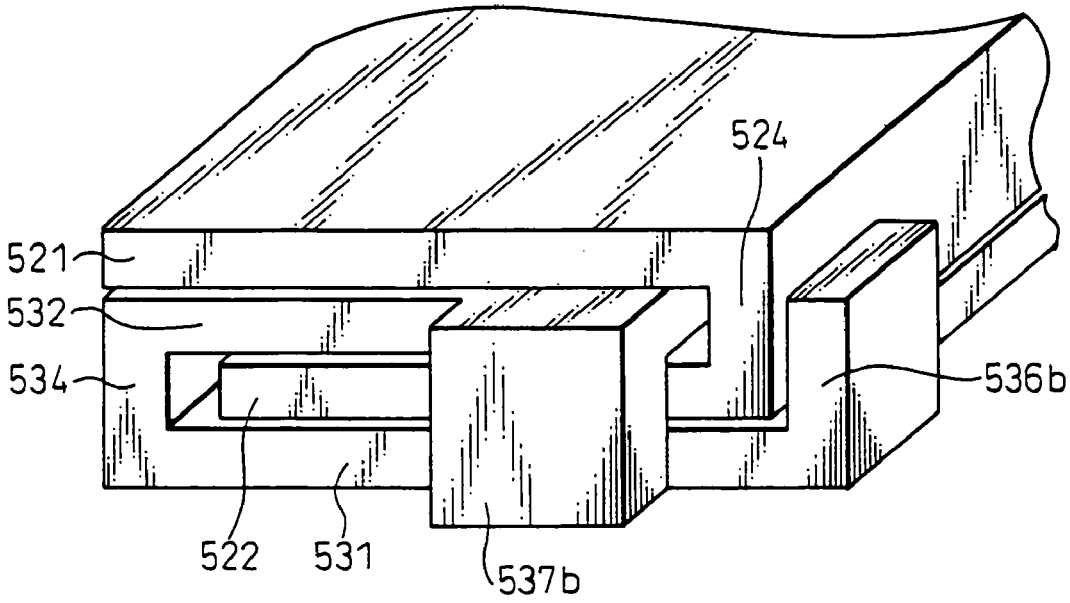

Moreover, in the present embodiment, as shown in FIG. 13, which is a perspective view showing only the ends of the first and second side plates 521 and 531, the second side plate 531 and the second engagement plate 532 are provided with protruding plates 536*a* and 537*a*, respectively, and after the first radiator 502 and the outdoor heat exchanger 503 are slid and assembled, stop parts 536*b* and 537*b* are formed by bending the protruding plates 536*a* and 537*a*.

In other words, the protruding plate 536*a* is formed by extending a part of the end of the second side plate 531 near the opening in the direction of thickness of the second heat exchanger 503*a* when the second side plate 531 is formed by press molding. At the same time, a recess 360 is provided at the boundary between the protruding plate 536*a* and the second side plate 531. Then, after the first and second heat exchange cores 502*a* and 503*a* are assembled by sliding, the protruding plate 536*a* is bent substantially through the right angle at the recess 360, which acts as a groove for bending a plate easily, in the direction toward the first engagement plate 521 and, thereby, the stop part 536*b* extending in this direction is formed. Due to the stop part 536*b* and the connection part 534 provided on the second side plate 531, the first heat exchange core 502*a* and the second heat exchange core 503*a* can be prevented from moving in the direction of thickness.

On the other hand, the protruding plate 537*a* is formed by extending a part of both ends (only one end is shown in FIG. 13) of the second engagement plate 532 in the direction perpendicular to the direction of thickness of the second heat exchange core 503*a*, that is, in the direction of width of the second heat exchange core 503*a* when the second side plate 531 is formed by press molding. Then, after the first and second heat exchange cores 502*a* and 503*a* are assembled by sliding, the protruding plate 537*a* is bent substantially through the right angle at a recess, not shown, which acts as a groove for bending a plate easily, in the direction toward the second side plate 531 and, thereby the stop part 537*b* extending in this direction is formed. The stop part 537*b* is provided on both ends of the second engagement plate 532 in the direction of width thereof and due to these stop parts 537*b*, the first heat exchange core 502*a* and the second heat exchange core 503*a* can be prevented from moving in the direction of width perpendicular to the direction of thickness.

As described above, by providing the stop parts 536*b* and 537*b*, together with the first and second engagement plates 522 and 532 and the connection parts 524 and 534, the first heat exchange core 502*a* and the second heat exchange core 503*a* are prevented from moving and are fixed on each other, after being assembled.

The second radiator 504 also has a structure similar to that of the first radiator 502. To be specific, the second radiator 504 comprises: a heat exchange core including flat tubes (not shown) through which cooling water flows to an engine and fins (not shown) joined to the flat surfaces of the tubes; header tanks (not shown) communicated with the plural tubes at both sides of the tubes in the longitudinal direction thereof; a reinforcement plate extending in parallel to the tubes 503*a* at the end of the heat exchange core, reinforcing the heat exchange core, and having a laid-down U-shaped section; etc. In the present embodiment, the tubes, the fins, the header tanks, and the reinforcement plate are all made of a metal such as an aluminum alloy and are integrally joined, by brazing, into one unit.

In the present embodiment, brackets 501*a* (refer to FIG. 9) for assembling the multiple heat exchanger 501 to a vehicle are joined by brazing to the header tanks 502*e* and 503*e*. Then, in an engine compartment of a vehicle, the multiple heat exchanger 501 is fixed with bolts via the brackets 501*a* at a position in front of the second radiator 504 so that the direction of thickness of the first and second heat exchange cores 502*a* and 503*a* coincides with the longitudinal direction of the vehicle, that is, the direction of the width of the first and second heat exchange cores 502*a* and 503*a* coincides with the transverse direction of the vehicle. Due to this, in the present embodiment, air taken in through a grill at the front of the vehicle passes firstly through the first and second heat exchange cores 502*a* and 503*a* of the multiple heat exchanger 501 and, after effecting heat exchange with the first and second heat exchange cores 502*a* and 503*a*, the air passes through the second radiator 504 and effects heat exchange with the second radiator 504.

Figure 29:
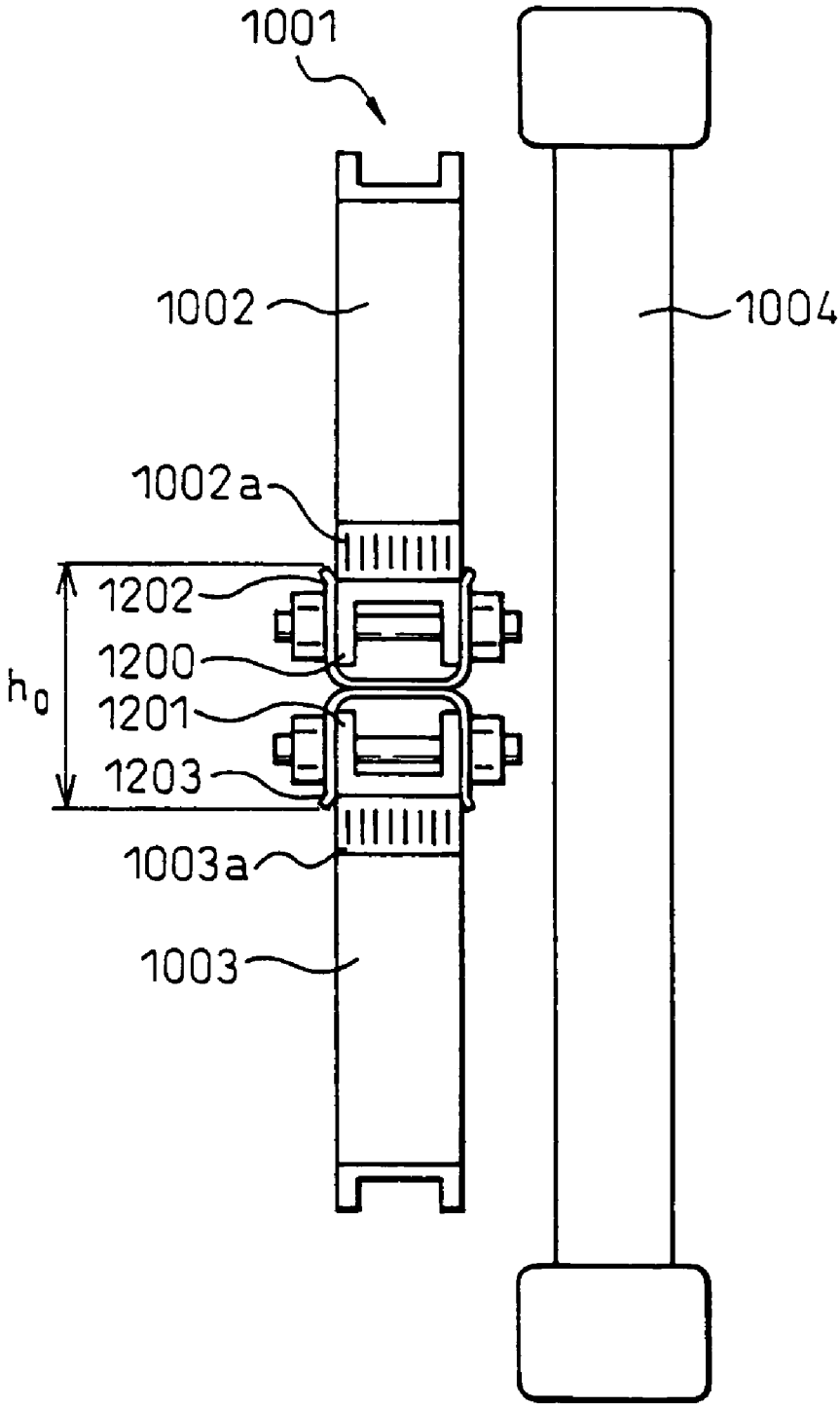
FIG. 29 is a diagram showing a multiple heat exchanger under examination.
Figure 30:
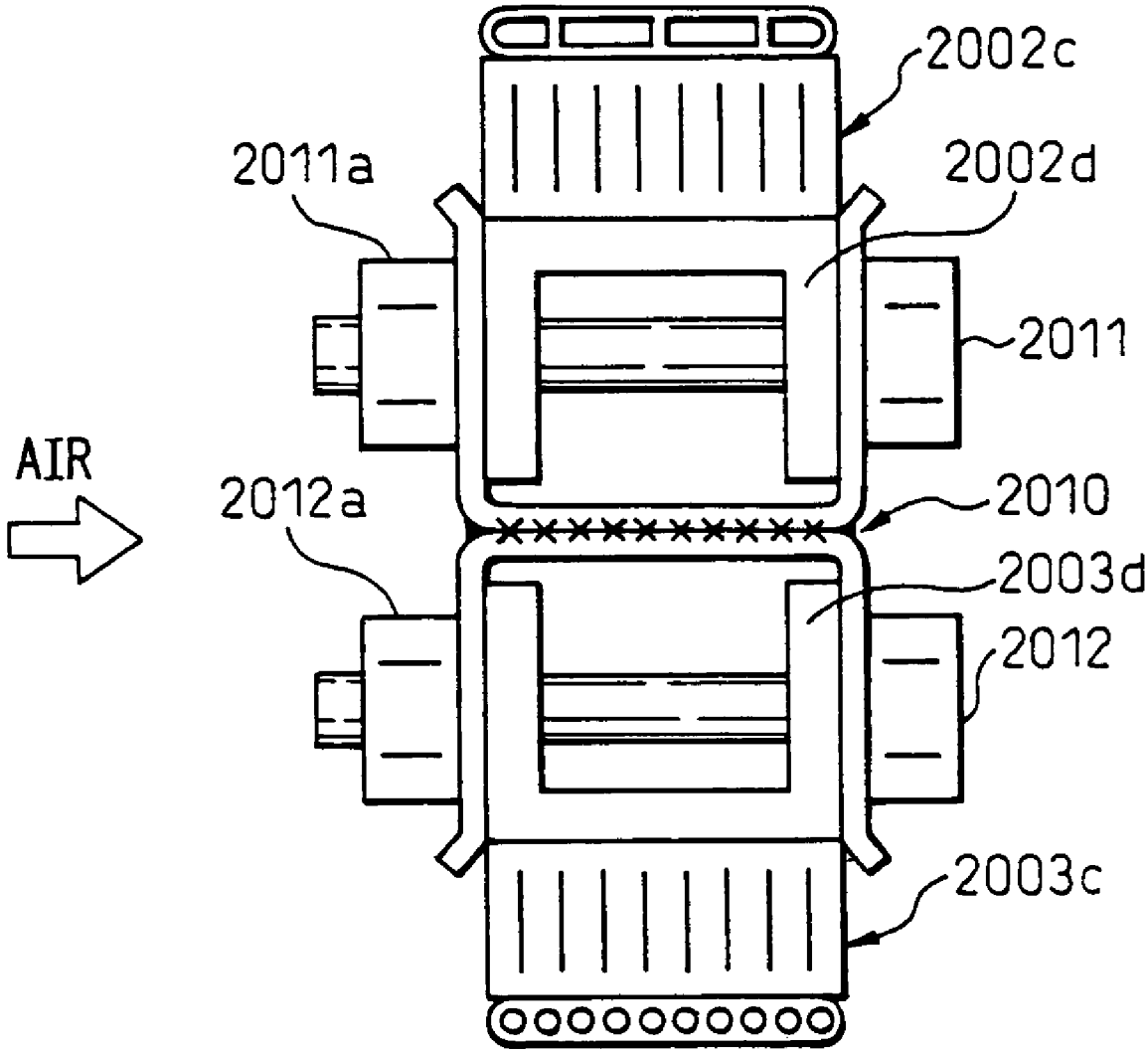
FIG. 30 is a sectional view showing an important part of another multiple heat exchanger under examination.

Next, the function and effect of the present embodiment are described below. In the present embodiment, the first heat exchange core 502*a* and the second heat exchange core 503*a* are joined by sliding the first and second engagement plates 522 and 532, which are provided on the first side plate 521 and the second side plate 531 fixed on the first engagement surface 520 and the second engagement surface 530 in opposition to each other, so as to be parallel to the first and second engagement surfaces 520 and 530 respectively, in parallel to each engagement surface and by placing them in the corresponding spaces 523 and 533. Due to this, the distance h between the first engagement surface 520 and the second engagement surface 530 after assembly becomes 4t (=approximately 6.4 mm) when the thickness of the first and second side plates 521 and 531 and the size of the spaces 523 and 533 are all equal to t. Therefore, the distance h between the first and second heat exchange cores 502*a* and 503*a* in the present embodiment can be made smaller than the distance h0=25 mm of the dead space in the multiple heat exchanger (FIG. 29) under examination.

In the present embodiment, by reducing the distance h between the first and second heat exchange cores, it is possible to increase the effective area for heat exchange of the first and second heat exchange cores 502*a* and 503*a* without increasing the outer dimensions of the multiple heat exchanger 501, or in detail, the dimension in the direction perpendicular to the first and second engagement surfaces 520 and 530. Moreover, in the present embodiment, it is possible to supply cooling air, at a high flow-rate, to the second radiator 504 at the downstream side compared to the case of the multiple heat exchanger under examination.

In the multiple heat exchanger 501 in the present embodiment, the first heat exchanger (the first radiator) 502 and the second heat exchanger (the outdoor heat exchanger) 503 are assembled by sliding the first and second side plates 521 and 531, which are joined in advance, by brazing, to the heat exchange cores 502*a* and 503*a*, respectively, and in parallel to each other, to engage the first engagement plates 522 and the second engagement plates 532 with each other and by fixing both by preventing the movement of both by means of the stop parts 536*b* and 537*b* provided on the ends of the respective side plates 521 and 531. Because of this, unlike the heat exchanger under examination, the brackets and bolts can be dispensed with and the number of parts and the number of assembling processes can be reduced.

(Seventh Embodiment)

Figure 14:
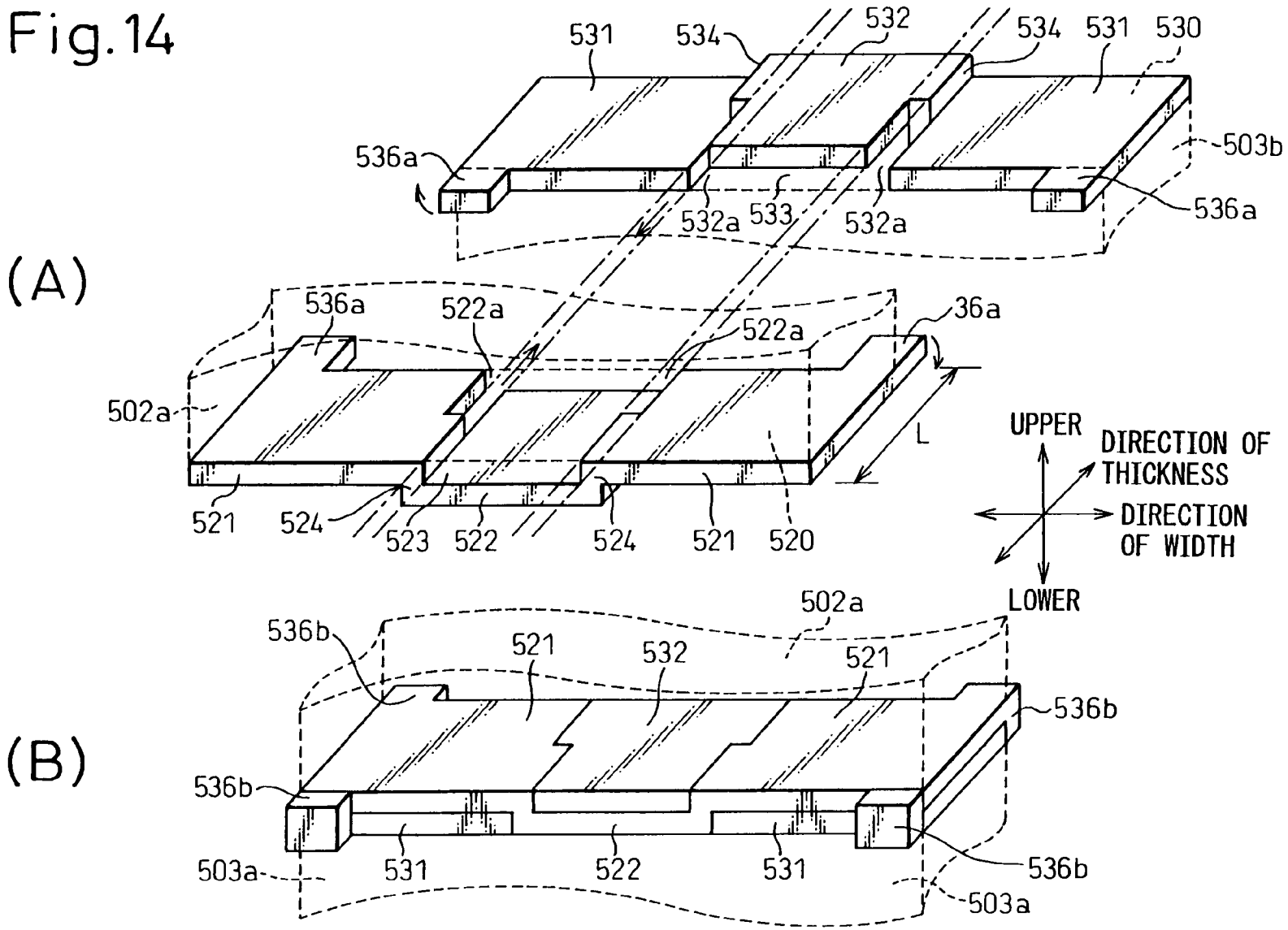
FIG. 14 is a perspective view of first and second side plates in a seventh embodiment of the present invention, in which (A) is a diagram showing a state before assembling by sliding and (B) is a diagram showing a state after the assembling by sliding.

FIG. 14 is a perspective view showing only the first side plate 521 and the second side plate 531 in a seventh embodiment when viewed from obliquely above. FIG. 14 (A) shows a state before the first heat exchanger 502 and the second heat exchanger 503 are assembled and FIG. 14 (B) shows a state after the first heat exchanger 502 and the second heat exchanger 503 are assembled. In the seventh embodiment, the configuration is the same as that in the above-mentioned sixth embodiment except for the shapes of the first and second side plates 521 and 531 and, therefore, in FIG. 14, a part of the first heat exchange core 502*a* of the first heat exchanger 502 and a part of the second heat exchange core 503*a* of the second heat exchanger 502 are shown by the dotted line and a description is omitted.

The first side plate 521 is formed by press molding from a metal plate of such as an aluminum alloy (for example, the thickness t=approximately 2 mm) so that the central part in the direction of width of the first heat exchange core 502*a* is raised to form the first engagement plate 522 parallel to the first side plate 521 and having a rectangular shape. Moreover, the first engagement plate 522 is formed so that the two sides of the first side plate 521 in opposition to each other, which extend in a direction of thickness of the first heat exchange core 502*a*, have respective cutouts 522*a* having a length of L/2, which is half of the distance L of the first side plate 521 in the direction of thickness and having a width t corresponding to the plate thickness of the second side plate 531, and so that the remaining parts (having a length of L/2) form the connection parts 524 connecting the first side plate 521 and the first engagement plate 522. Due to this, the space 523 having the thickness t is formed between the first engagement plate 522 and the first engagement surface 520 of the first heat exchange core 502*a* and the total thickness from the first engagement surface 520 to the bottom surface of the first engagement plate 522 including the space 523 becomes 2t.

At both ends in the direction of width of the side plate 521 on the side where the cutouts 522*a* are formed, the protruding plates 536*a* (FIG. 14 (A)) protruding in the direction of thickness are formed at the time of press molding of the first side plate 521.

The second side plate 531 is also configured in a manner similar to that of the first side plate 521. The first side plate 521 is joined in advance to the first engagement surface 520 of the first heat exchange core 502*a* by brazing and the second side plate 531 is joined in advance to the second engagement surface 530 of the second heat exchange core 503*a* by brazing.

In order to assemble the first and second heat exchangers 502 and 503, the cutouts 522*a* of the first engagement plate 522 and cutouts 532*a* of the second engagement plate 532 are placed in opposition to each other and the first side plate 521 and the second side plate 531 are slid in a direction to become closer to each other, to place the first engagement plate 522 within the space 533 between the second engagement plate 532 and the second engagement surface 530 and to place the second engagement plate 532 within the space 523 between the first engagement plate 522 and the second engagement surface 520. As a result, the distance h between the first engagement surface 520 of the first heat exchange core 502*a* and the second engagement surface 530 of the second heat exchange core 503*a* corresponds to a thickness 2t of both the first side plate 521 and the second side plate 531 overlapped each other.

After this sliding process, the two protruding plates 536*a* in the direction of width provided on the second side plate 531 are bent substantially through the right angle toward the direction of the first side plate 521, respectively, to form stop parts 536*b* and, thereby, the assembly of the multiple heat exchanger 501 in the present embodiment is completed. In other words, as the first engagement plate 522 and the connection parts 534 of the second side plate 531 come into contact with each other and the second engagement plate 532 and the connection parts 524 of the first side plate 521 come into contact with each other, the first and second side plates 521 and 531 are prevented from moving in the direction of width and also prevented from moving in the direction of thickness by the stop parts 536*b* provided on the first and second side plates 521 and 531, respectively and, thus, the first heat exchanger 502 and the second heat exchanger 503 are joined.

As described above, in the seventh embodiment, the distance h between the first heat exchange core 502*a* and the second heat exchange core 503*a* can be reduced to the sum (2t) of the plate thickness of the first side plate 521 and that of the second side plate 531 and, therefore, it is possible, in a manner similar to that in the above-mentioned sixth embodiment, to increase the effective area for heat exchange of the first and second heat exchange cores 502*a* and 503*a* without increasing the outer dimensions of the multiple heat exchanger 501, or in detail, the dimension in the direction perpendicular to the first and second engagement surfaces 520 and 530. Moreover, in the present embodiment, it is possible to supply cooling air at a high flow-rate to the second radiator 504 at the downstream side compared to the case of the multiple heat exchanger under examination.

In the seventh embodiment, a case where only one set of the first engagement plate 522 and the second engagement plate 532 is provided is shown, but two or more sets may be arranged separately from each other in the direction of width.

(Other Embodiments)

In the sixth embodiment described above, the stop parts 536*b* and 537*b* are provided on the respective ends of the second side plate 531 and the second engagement plate 532 in order to prevent the first and second side plates 521 and 531 from moving after the first and second heat exchangers 502 and 503 are assembled, but the positions of arrangement of the stop parts are not limited to the ends. There can be various combinations as follows.

(1) The stop parts 537*b* bent substantially through the right angle toward the direction of the first engagement plate 522 may be provided at the right and left ends of the first side plate 521 in the direction of width in order to prevent movement thereof in the direction of width and the stop part 536*b* that prevents movement in the direction of width may be provided on the second side plate 531 in a manner similar to that in the sixth embodiment.

(2) The stop parts 537*b* bent substantially through the right angle toward the direction of the first side plate 521 may be provided at the right and left ends of the first engagement plate 522 in the direction of width in order to prevent movement thereof in the direction of width and the stop part 536*b* that prevents movement in the direction of thickness may be provided on the second side plate 531 in a manner similar to that in the sixth embodiment.

(3) In FIG. 13, the explanation is given on the assumption that the side plate located at the upper side in the figure is referred to as the first side plate and the side plate at the lower side is referred to as the second side plate. However, the positions of the upper side plate and the lower side plate may be exchanged and, on the assumption that the upper side plate is referred to as the second side plate and the lower side plate is referred to as the first side plate, the stop part 536*b* that prevents movement in the direction of thickness may be provided at the end of the first side plate and the stop parts 537*b* that prevent movement in the direction of width may be provided at the right and left ends of the first engagement plate. Moreover, the positions of the first side plate and the second side plate may be exchanged in the configurations of (1) and (2) described above.

In the sixth and seventh embodiments, cases are explained where the stop parts that prevent the first and second side plates 521 and 531 from moving are formed by bending the protruding plates, in proper directions after assembling, which have been provided to the first and second side plates or the first and second engagement plates at the time of press molding, but the stop parts may be formed as follows, not limited to these cases.

Figure 15:
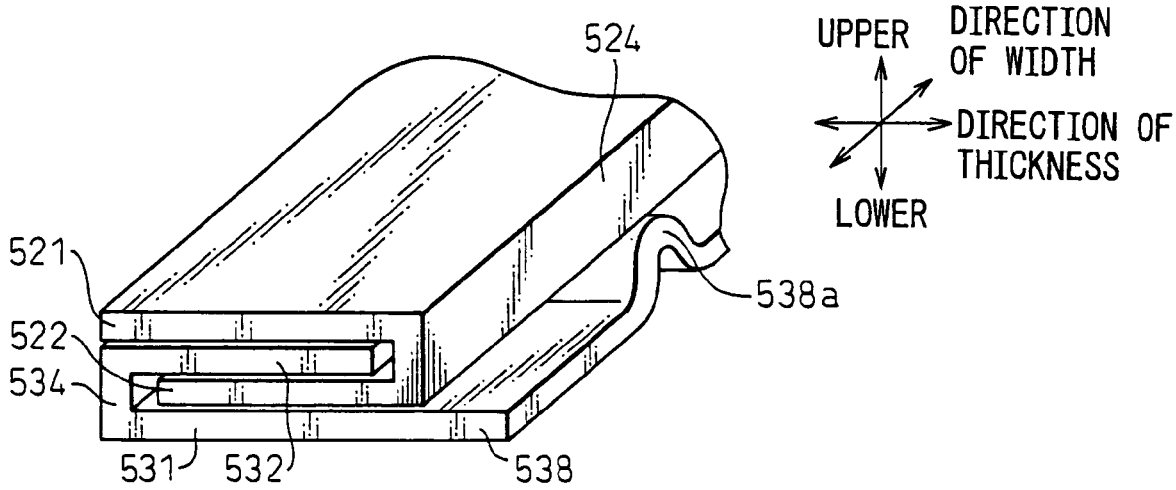
FIG. 15 is a perspective view of first and second side plates in other embodiments.

(4) FIG. 15 is a perspective view showing only the ends of the first and second side plates 521 and 531. In an example shown in FIG. 15, an end 538 of the second side plate 531 in the direction of thickness of the second heat exchange core is extended and after the first and second heat exchangers 502 and 503 are assembled by sliding, a protrusion 538*a* is formed by deforming a proper part of the end 538 upward in FIG. 15 (in the direction toward the first heat exchange core). Due to this, the protrusion 538*a* and the connection part 524 of the first side plate 521 come into contact with each other and the first side plate 521 and the second side plate 531 are prevented from moving in the direction of thickness.

Figure 16:
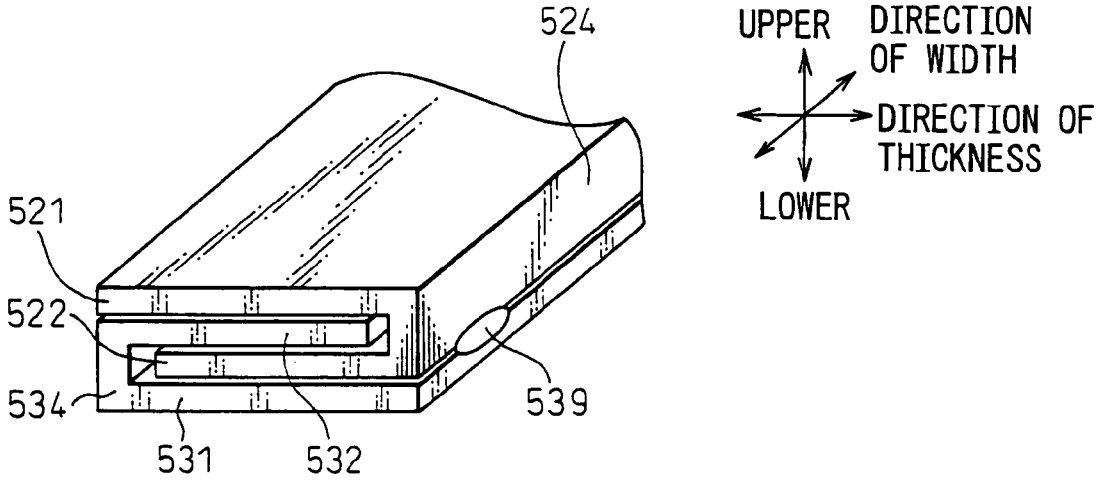
FIG. 16 is a perspective view of first and second side plates in other embodiments.

(5) FIG. 16 is a perspective view showing the ends of only the first and second side plates 521 and 531. In an example shown in FIG. 16, after the first and second heat exchangers 502 and 503 are assembled by sliding, the connection part 524 of the first side plate 521 and an end of the second side plate 531 in the direction of thickness can be joined at a proper part 539 by joining means such as brazing, arc welding, or laser welding. In this case, movement in the direction of width as well as in the direction of thickness can be prevented. In addition to the example shown in FIG. 16, for example, the first engagement plate 522 and the second engagement plate 523 may be joined, or the first side plate 521 and the second engagement plate 532, or the first side plate 521 and the second engagement plate 532 may be joined at the ends in the direction of width as joining parts 539.

Figure 17:
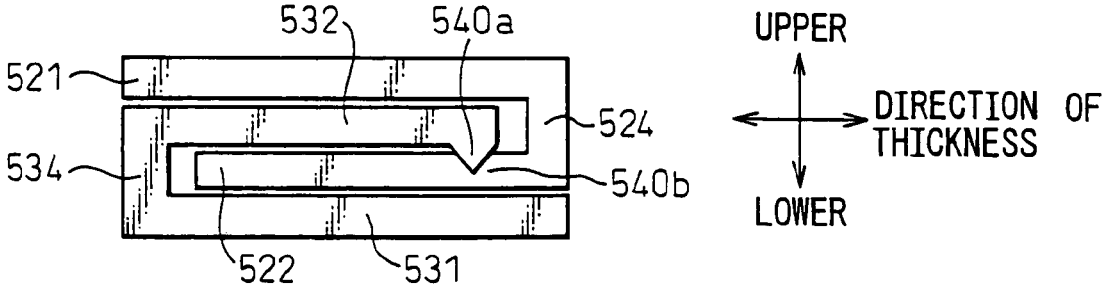
FIG. 17 is a sectional view of first and second side plates in other embodiments.

(6) FIG. 17 is a sectional view of only the first and second side plates 521 and 531 in the direction of thickness. In an example shown in FIG. 17, an insertion recess 540*b* is provided in advance on the surface of the first engagement plate 522 in opposition to the first side plate 521 (that is, the second engagement plate 532) and, at the same time, an insertion protrusion 540*a* is provided in advance on the surface of the second engagement plate 532 in opposition to the second side plate 531 (that is, the first engagement plate 522). By inserting the insertion protrusion 540*a* into the insertion recess 540*b* when the first and second side plates 521 and 531 are assembled by sliding, the first side plate 521 and the second side plate 531 are prevented from moving on the surface in parallel to the direction of thickness and both can be joined fixedly. In this case also, the insertion protrusion 540*a* may be provided on the first engagement plate 522 and the insertion recess 540*b* may be provided on the second engagement plate 532.

In the sixth embodiment, an example is explained in which the first engagement plate 522 and the second engagement plate 532 are provided across the whole length of the first heat exchanger 502 and the second heat exchanger 503 in the direction of width, respectively, but the engagement plates may be configured as follows, and are not limited to this example.

(7) For example, the first and second engagement plates 522 and 523 may be made into respective rectangular chips and arranged at a few separate points in the direction of width of the first and second heat exchange cores 502*a* and 503*a*. In this case, the respective chips are fixed on the side of the first side plate 521 or the second side plate 531 in the direction of width via the connection part 524 or 534 in a manner similar to that in the sixth embodiment described above.

(8) Moreover, in the above-mentioned description in (7), the connection parts 524 and 534 that connect the rectangular first engagement plate 522 and the first side plate 521, or the rectangular second engagement plate 532 and the second side plate 531, respectively, may be provided, in addition to the sides in the direction of width, on one or two sides next to the sides in the direction of width, or on the side in opposition to the sides in the direction of width. In this case, the side on which the connection part is provided needs to be set so as not to interfere with the connection part of the opposite side plate at the time of slide assembling. As described above, by providing the connecting parts on two or more sides of the first or second engagement plate, the connection parts can prevent each side plate from moving in a manner similar to that of the stop parts in the sixth and seventh embodiments.

Moreover, in the embodiments described above, examples are shown, where the first engagement plate 522 and the second engagement plate 532 are parallel to the first side plate 521 and the second side plate 531, respectively, that is, the spaces 523 and 533 have a constant size, respectively, but the engagement plates can be configured as follows and are not limited to these examples.

(9) For example, the first engagement plate 522 (and the first side plate 521) may be formed so that the space 523 of the first side plate 521 is tilted with respect to the first engagement surface 520 in the direction of thickness and the section of the second engagement plate 532 may be formed into a shape that can be inserted into the space 523. In this case, the first and second heat exchangers 502 and 503 can be assembled by sliding in the direction of width, not in the direction of thickness.

(Eighth Embodiment)

Figure 18:
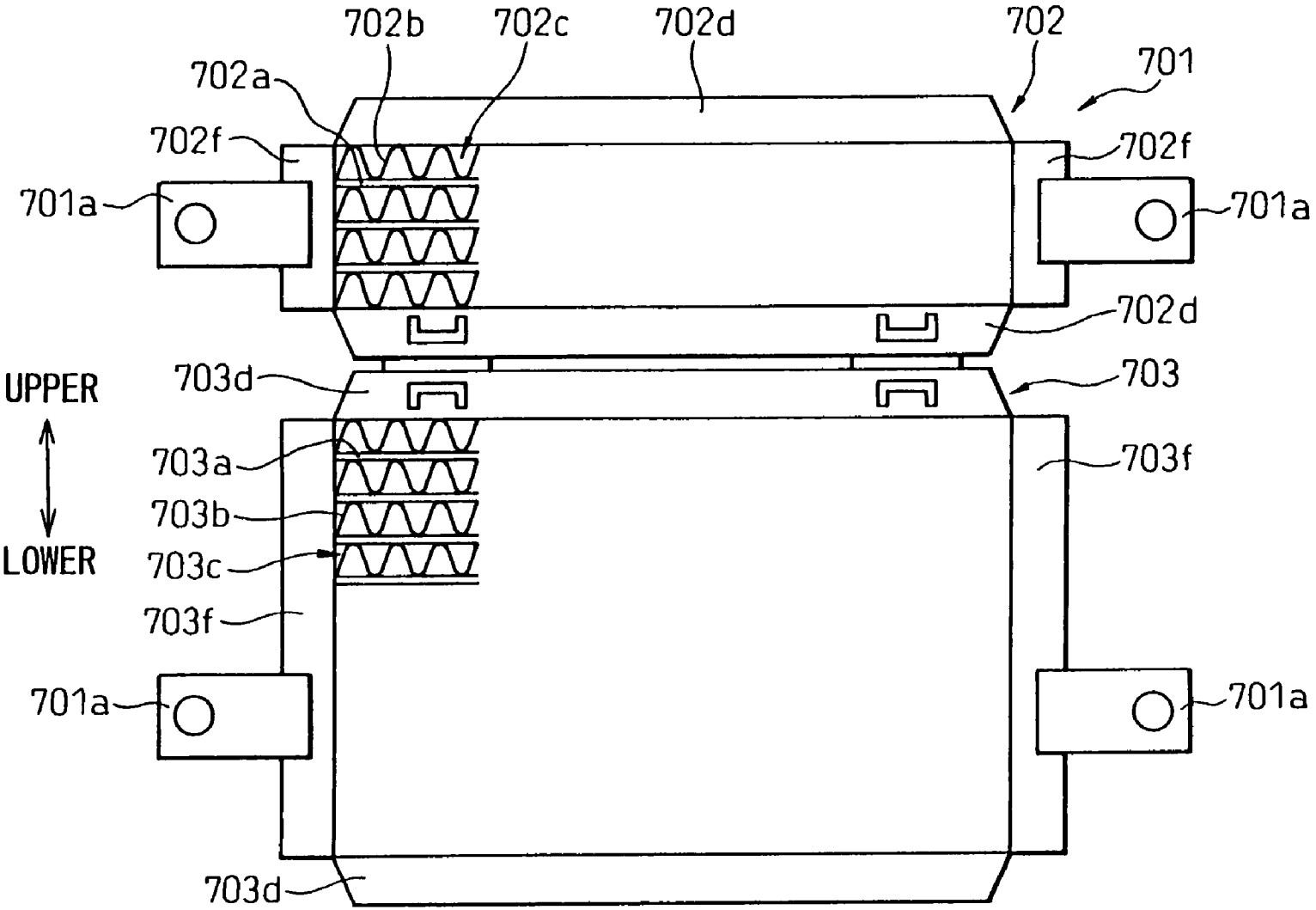
FIG. 18 is a diagram showing the characteristics of a multiple heat exchanger according to an eighth embodiment of the present invention.
Figure 19:
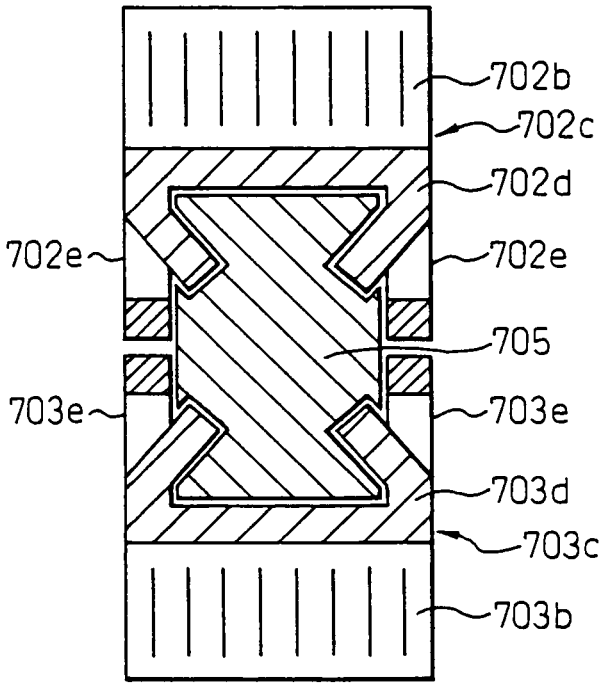
FIG. 19 is a sectional view showing an important part of the multiple heat exchanger according to the eighth embodiment of the present invention.
Figure 20:
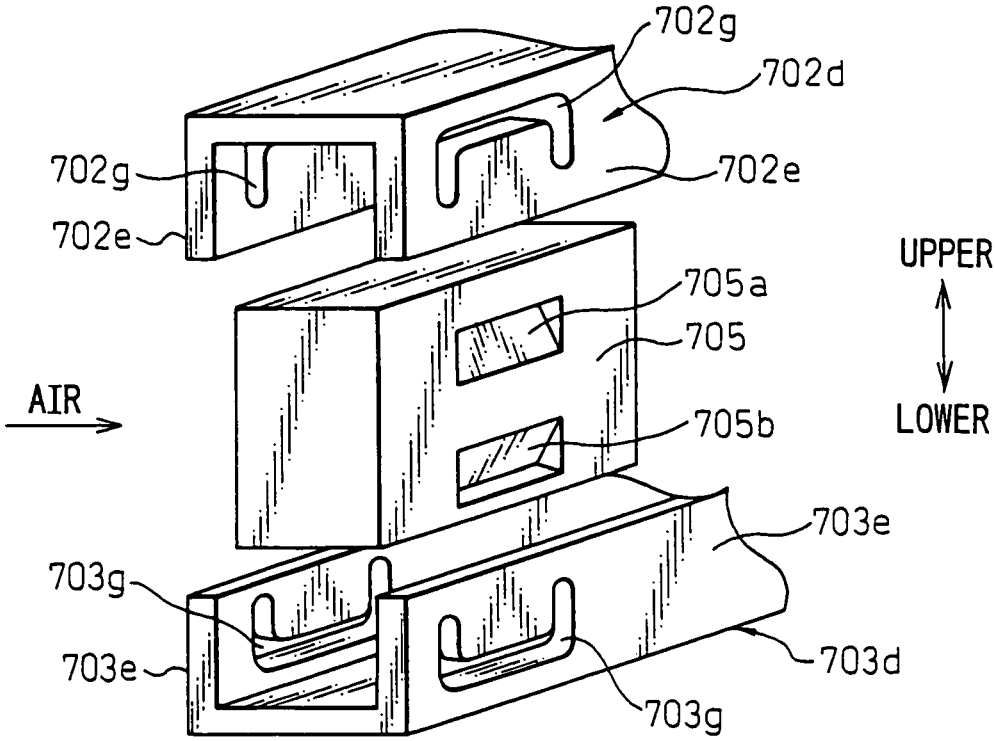
FIG. 20 is an exploded perspective view of a coupled part of the multiple heat exchanger according to the eighth embodiment of the present invention.

In the present embodiment, the multiple heat exchanger according to the present invention is applied to a cooling device for a hybrid vehicle. FIG. 18 is a diagram showing the characteristics of a multiple heat exchanger 701 according to the present embodiment, FIG. 19 is a sectional view showing an important part of the multiple heat exchanger 701, FIG. 20 is an exploded perspective view of the joined part, and FIG. 21 is a diagram showing a state in which the multiple heat exchanger 701 according to the present embodiment is mounted on a vehicle.

Figure 21:
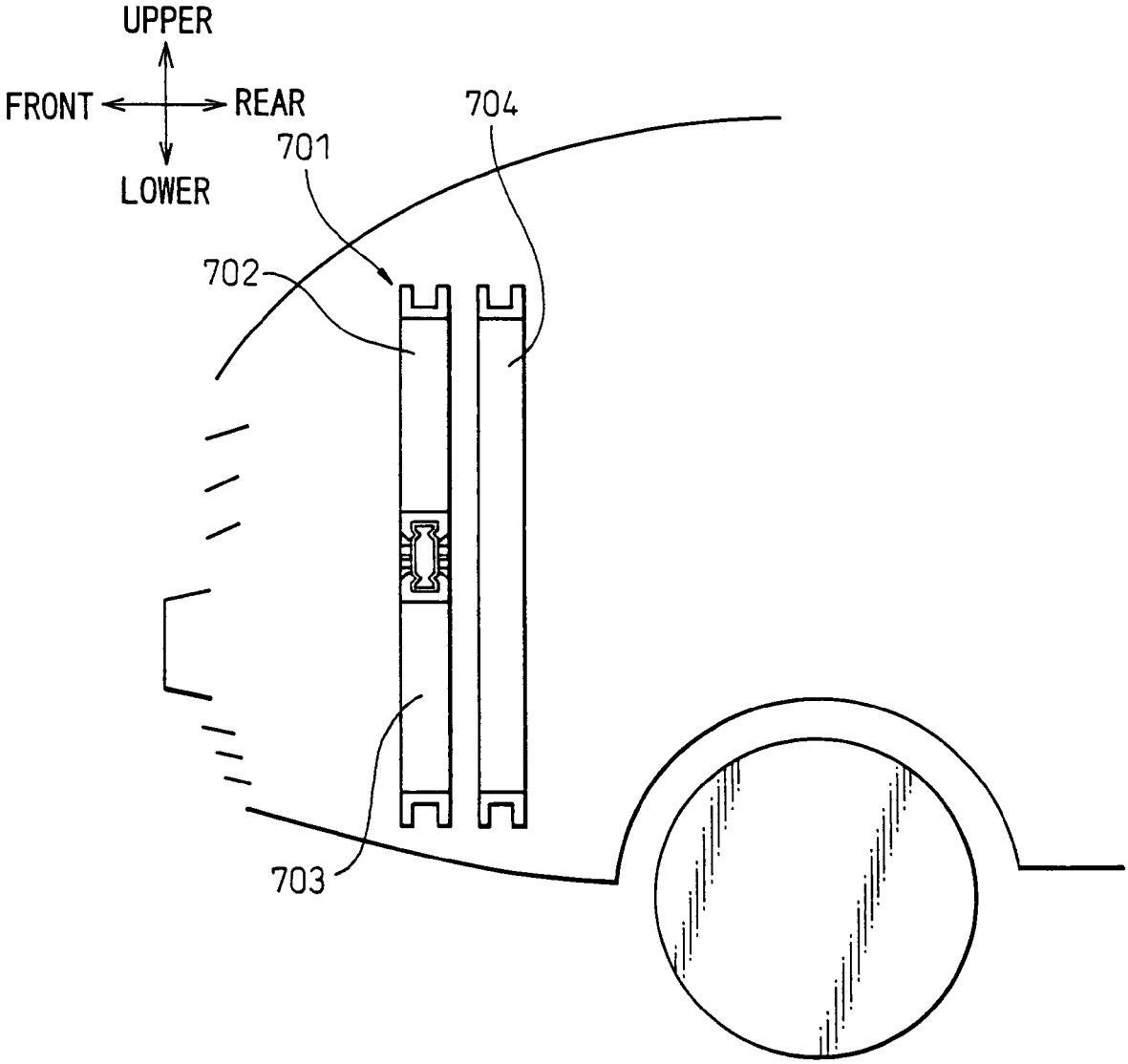
FIG. 21 is a diagram showing a state in which the multiple heat exchanger according to the eighth embodiment of the present invention is mounted on a vehicle.

The multiple heat exchanger 701 according to the present embodiment is mounted on the front end of a vehicle as shown in FIG. 21.

As shown in FIG. 18, the multiple heat exchanger 701 according to the present embodiment comprises: a first radiator 702 that effects heat exchange between inverter cooling water and air, which water cools an electric motor for moving a vehicle (not shown) and drive circuits such as an inverter circuit for controlling a drive current to the electric motor; an outdoor heat exchanger 703 of an air conditioner for a vehicle (a vapor compression type refrigerator); etc.

The first radiator 702 and the outdoor heat exchanger 703 are arranged in parallel to each other with respect to the cooling air flow direction at the upstream side of a second radiator 704 in the cooling air flow direction. In the present embodiment, the first radiator 702 is arranged above the outdoor heat exchanger 703.

At the downstream side of the multiple heat exchanger 701, that is, the first radiator 702 and the outdoor heat exchanger 703 in the air flow direction, as shown in FIG. 20, the second radiator 704 is arranged that effects heat exchange between engine cooling water and air, which water cools an internal combustion engine for moving a vehicle (not shown).

The first radiator 702 comprises, as shown in FIG. 18: a first heat exchange core 702*c* including flat tubes 702*a* through which inverter cooling water flows and fins 702*b* joined to the flat surfaces of the tubes 702*a*; header tanks 702*f* communicated with the plural tubes 702*a* at both ends in the longitudinal direction of the tubes 702*a*; first reinforcement plates 702*d* extending in parallel to the tubes 702*a* at the ends of the first heat exchange core 702*c* and reinforcing the first heat exchange core 702*c*; etc.

In the present embodiment, the first reinforcement plate 702*d* is formed by press molding so as to have two wall surfaces 702*e* in opposition to each other in the cooling air flow direction, that is, in the longitudinal direction of a vehicle, and to have a section substantially in a laid-down U-shape that opens in the direction perpendicular to the cooling air flow direction, that is, in the vertical direction, as shown in FIG. 20.

In the present embodiment, the tubes 702*a*, the fins 702*b*, the header tanks 702*f*, and the first reinforcement plates 702*d* are all made of a metal such as an aluminum alloy and are integrally joined, by brazing, into one unit.

The second radiator 703 has a structure similar to that of the first radiator 702. To be specific, the second radiator 703 comprises: a heat exchange core including flat tubes (not shown) through which cooling water flows to an engine and fins (not shown) joined to the flat surfaces of the tubes; header tanks (not shown) communicated with the plural tubes at both ends in the longitudinal direction of the tubes; reinforcement plates extending in parallel to the tubes 703*a* at the ends of the heat exchange core, reinforcing the heat exchange core, and having a section substantially in a laid-down U-shape; etc. In the present embodiment, the tubes, the fins, the header tanks, and the reinforcement plates are all made of a metal such as an aluminum alloy and are integrally joined by brazing into one unit.

The outdoor heat exchanger 703 also has a structure similar to that of the first radiator 702. To be specific, the outdoor heat exchanger 703 comprises, as shown in FIG. 18: a second heat exchange core 703*c* including flat tubes 703*a* through which a refrigerant flows and fins 703*b* joined to the flat surfaces of the tubes 703*a*; header tanks 703*f* communicated with the plural tubes 703*a* at both ends in the longitudinal direction of the tubes 703*a*; second reinforcement plates 703*d* extending in parallel to the tubes 703*a* at the ends of the second heat exchange core 703*c*, reinforcing the second heat exchange core 703*c*, and having a section substantially in a laid-down U-shape; etc. In the present embodiment, the tubes 703*a*, the fins 703*b*, the header tanks 703*f*, and the second reinforcement plates 703*d* are all made of a metal such as an aluminum alloy and are integrally joined, by brazing, into one unit.

In the present embodiment, the longitudinal direction of the tubes 702*a* and 703*a* is made to coincide with the horizontal direction and, at the same time, a wavy corrugated fin formed as a louver in order to improve the heat transfer efficiency by disturbing the air flow is employed as the fins 702*b* and 703*b*.

Moreover, brackets 701*a* are joined, by brazing, to the header tanks 702*f* and 703*f* in order to install the heat exchanging module 701 to a vehicle.

The first reinforcement plate 702*d* near the outdoor heat exchanger 703 and the second reinforcement plate 703*d* near the first radiator 702 are coupled, as shown in FIG. 19, via a coupling member 705 interposed between the two wall surfaces 702*e* of the first reinforcement plate 702*d* and between two wall surfaces 703*e* of the second reinforcement plate 703*d*.

As shown in FIG. 20, slots 702*g* and 703*g* substantially in a laid-down U-shape are formed in the wall surfaces 702*e* of the first reinforcement plate 702*d* and in the wall surfaces 703*e* of the second reinforcement plate 703*d*, respectively, and recesses 705*a* and 705*b* are formed in portions of the coupling member 705 corresponding to the slots 702*g* and 703*g*. Then, the portions of the wall surfaces 702*e* and 703*e* surrounded by the slots 702*g* and 703*g* are deformed plastically toward the coupling member 705 and are inserted into the recesses 705*a* and 705*b*, thereby the first reinforcement plate 702*d* and the coupling member 705 are fixed on each other by calking, the second reinforcement plate 703*d* and the coupling member 705 are fixed on each other by calking and, thus, the first reinforcement plate 702*d* near the outdoor heat exchanger 703 and the second reinforcement plate 703*d* near the first radiator 702 are coupled via the coupling member 705.

In the present embodiment, the coupling member 705 is formed from a metal (for example, an aluminum alloy) or a hard resin (for example, a glass-fibered polypropylene or a glass-fibered nylon 6, 6).

Next, the function and effect of the present embodiment are described below.

In the present embodiment, the first reinforcement plate 702*d* of the first heat exchange core 702*c* and the second reinforcement plate 703*d* of the second heat exchange core 703*c* are coupled via the coupling member 705 interposed between the two wall surfaces 702*e* of the first reinforcement plate 702*d* and between the two wall surfaces 703*e* of the second reinforcement plate 703*d* and, therefore, as shown in FIG. 19, the maximum width of the multiple heat exchanger 701, that is, the maximum dimension of a portion of the multiple heat exchanger 701 in parallel to the air flow direction coincides with the width of the first reinforcement plate 702*d* and the second reinforcement plate 703*d*, that is, the width of the first heat exchange core 702*c* and the second heat exchanger core 703*c*.

Figure 22:
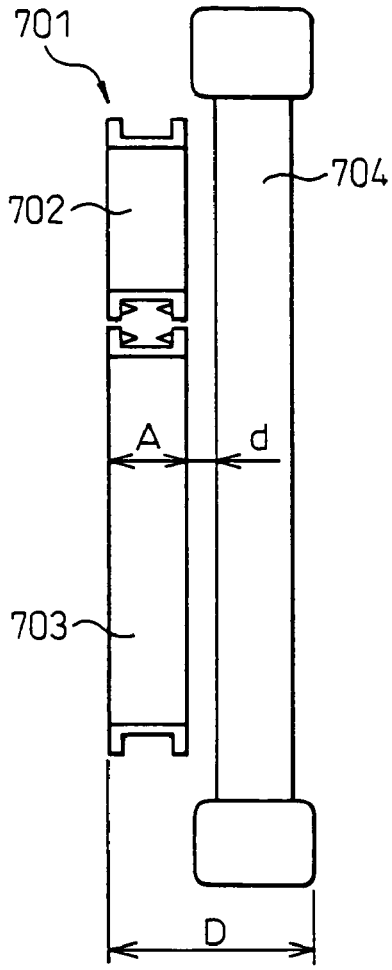
FIG. 22 is a diagram showing a state in which the multiple heat exchanger according to the eighth embodiment of the present invention is mounted on a vehicle.
Figure 31:
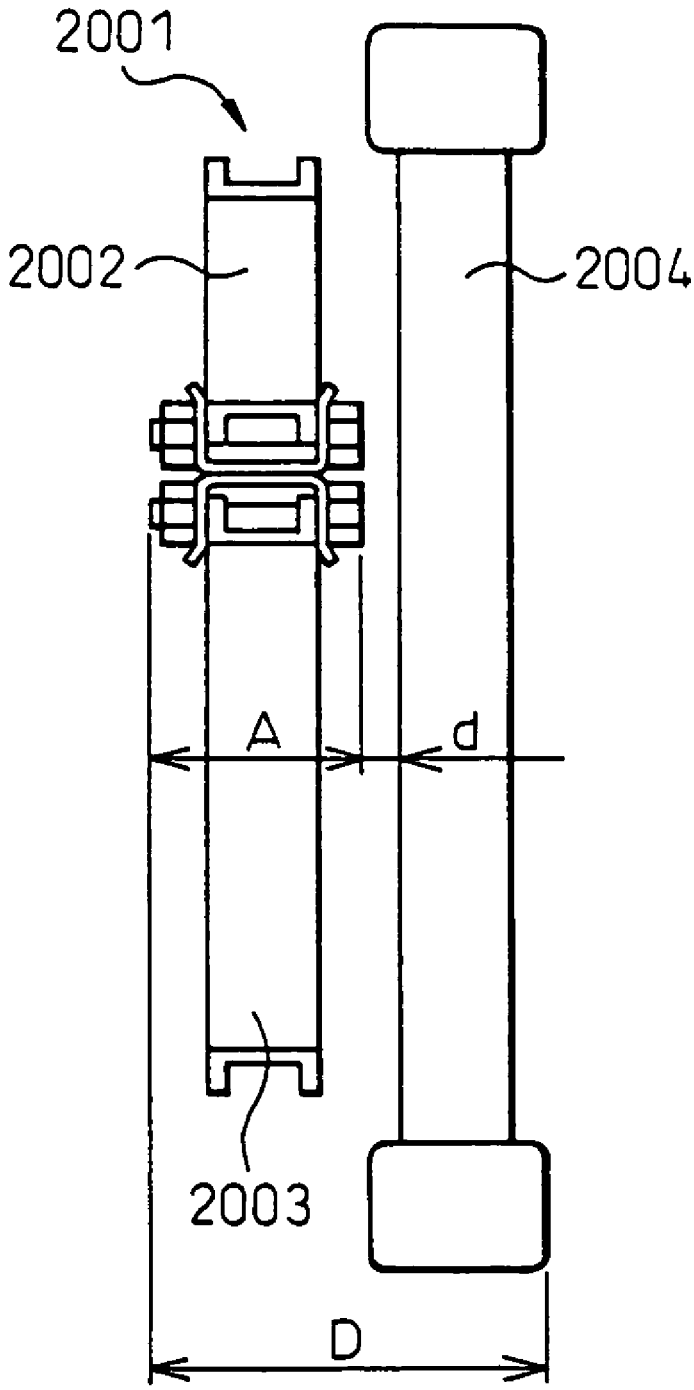
FIG. 31 is a diagram showing a state in which another multiple heat exchanger under examination is mounted on a vehicle.

As a result, it is possible to prevent the maximum width of the multiple heat exchanger 701 from exceeding the width of the first heat exchange core 702*c* or the width of the second heat exchange core 703*c* and, therefore, as shown in FIG. 22, even if a space having the size d is provided between the multiple heat exchanger 701 and the heat exchanger 704 in order to prevent interference therebetween, the width D of the cooling device including the multiple heat exchanger 701 and the additional heat exchanger 704 (the second radiator 704) can be made smaller than that of the heat exchanger under examination (refer to FIG. 31).

Moreover, the safety from collision can be improved by ensuring a large crushable zone and, at the same time, as the flow rate of air to be supplied to the second radiator 704 arranged at the downstream side of the multiple heat exchanger 701 in the air flow direction can be prevented from decreasing, it is possible to prevent the capability of the heat exchanger at the downstream side in the air flow direction from decreasing.

As the coupling member 705 and both the first reinforcement plate 702*d* and the second reinforcement plate 703*d* are fixed on each other by calking, the coupling member 705 and both the first reinforcement plate 702*d* and the second reinforcement plate 703*d* can be fixed firmly.

(Ninth Embodiment)

Although the coupling member 705 is formed from a metal or a resin in the eighth embodiment, a coupling member is formed from an elastic material, such as rubber, that can deform elastically, in a ninth embodiment.

Due to this, even if vibrations produced by a compressor of an air conditioner for a vehicle are transferred to the outdoor heat exchanger 703, the coupling member 705 can prevent the vibrations from being transferred from the outdoor heat exchanger 703 to the first radiator 2 and, therefore, the whole multiple heat exchanger 701 can be protected from vibration.

As a result, it is possible to reduce vibrations and noises produced by the vibrations of the multiple heat exchanger 701.

(Tenth Embodiment)

As the coupling member 705 is formed from an elastic material in the ninth embodiment, there is a possibility that the coupled parts (the recesses 705*a* and 705*b*) of the coupling member 705 and the reinforcement plates 702*d* and 703*d* may deform elastically and the coupled state (caulked and fixed state) may be broken.

Figure 23:
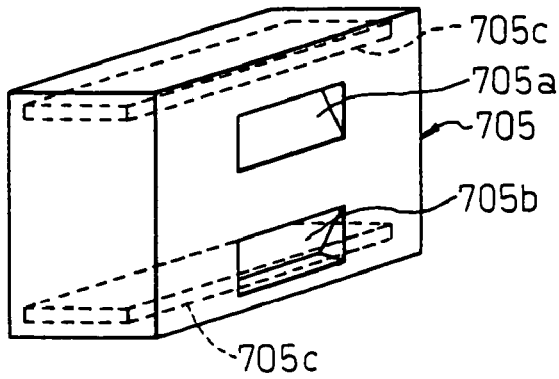
FIG. 23 is a perspective view of a coupling member according to a tenth embodiment of the present invention.

In a tenth embodiment, therefore, reinforcement members 705*c* that prevent deformation of the coupling member 705 are buried in portions of the coupling member 705 corresponding to the coupled parts between the coupling member 705 and the first reinforcement plate 702*d*, and between the coupling member 705 and the second reinforcement plate 703*d*, as shown in FIG. 23.

In the present embodiment, the reinforcement member 705*c* is made into a plate made of a metal such as an aluminum alloy and the reinforcement member 705*c* is integrally incorporated within the coupling member 705 by filling the mold with an elastic material in a state in which the reinforcement member 705*c* is placed in the mold (insert molding).

(Eleventh Embodiment)

Figure 24:
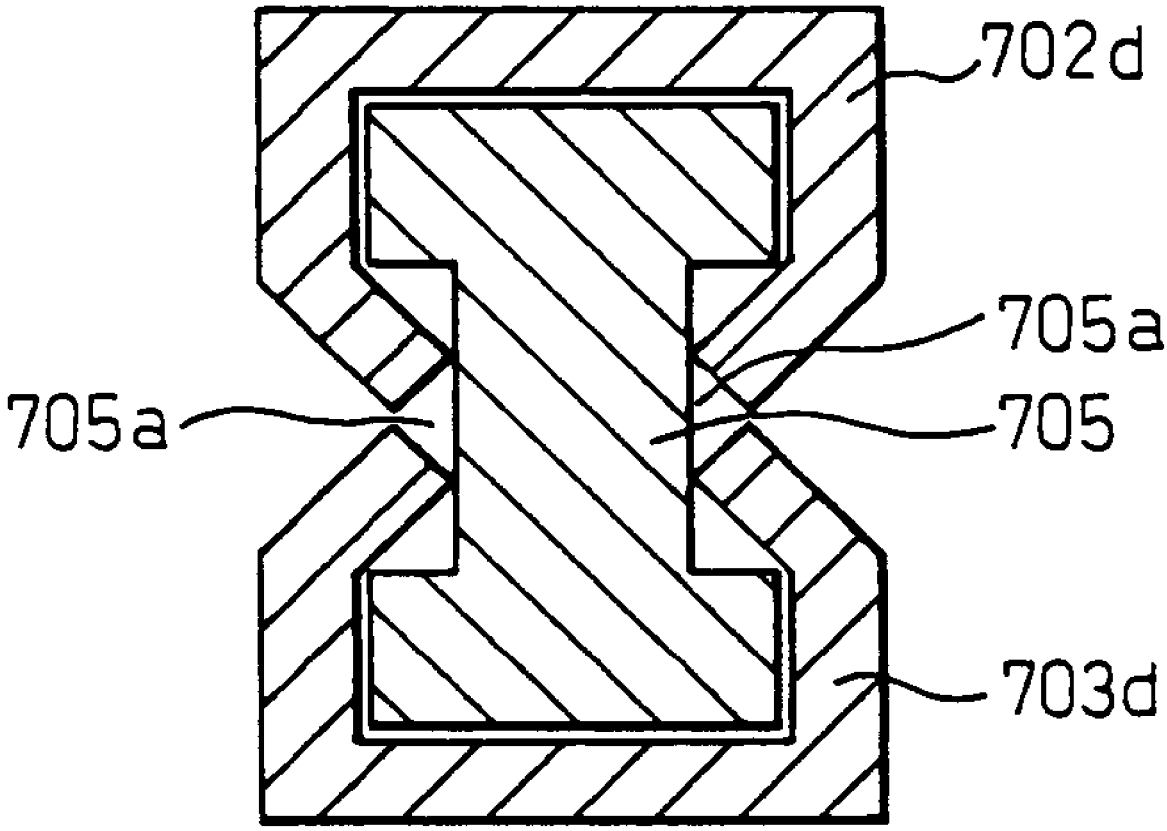
FIG. 24 is a sectional view showing an important part of a multiple heat exchanger according to an eleventh embodiment of the present invention.

In the eighth to tenth embodiments, the slits 702*g* and 703*g* substantially in a laid-down U-shape are formed in the wall surfaces 702*e* of the first reinforcement plate 702*d* and in the wall surfaces 703*e* of the second reinforcement plate 703*d*, and the portions of the wall surfaces 702*e* and 703*e* surrounded by the slits 702*g* and 703*g* are caulked toward the coupling member 705. In an eleventh embodiment, however, the slits 702*g* and 703*g* are not provided in the wall surfaces 702*e* and 703*e* and a part of the wall surfaces 702*e* and 703*e* is plastically deformed toward the coupling member 705 and, thereby the coupling member 705 and the first and second reinforcement plates 702*d* and 703*d* are fixed on each other by calking, as shown in FIG. 24.

Figure 25:
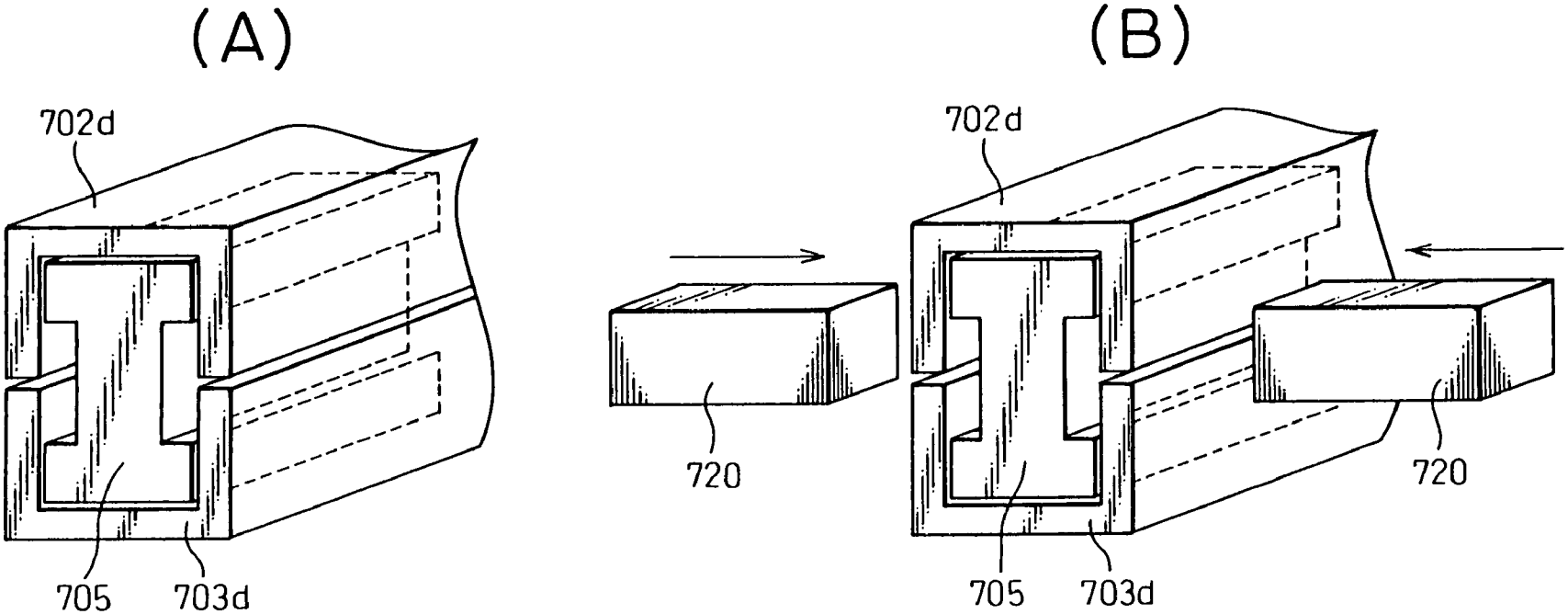
FIG. 25 is a diagram showing a caulking procedure of the multiple heat exchanger according to the eleventh embodiment of the present invention.

FIG. 25 shows the procedure of caulking the first and second reinforcement plates 702*d* and 703*d* with respect to the coupling member 705, and after the coupling member 705 is interposed between the first and second reinforcement plates 702*d* and 703*d* (refer to FIG. 25 (A)), parts of the wall surfaces 702*e* and 703*e* are plastically deformed toward the coupling member 705 by pressing the wall surfaces 702*e* and 703*e* with a caulking jig 720 (refer to FIG. 25 (B)).

(Twelfth Embodiment)

In the eighth to eleventh embodiments, the coupling member 705 and the first and second reinforcement plates 702*d* and 703*d* are fixed on each other by caulking. In a twelfth embodiment, however, engagement holes 702*h* and 703*h* are provided in the wall surfaces 702*e* of the first reinforcement plate 702*d* and in the wall surfaces 703*e* of the second reinforcement plates 703*d* and, at the same time, engagement projections 705*d* and 705*e* are provided on the coupling member 705, and the engagement projection 705*d* is inserted into the engagement hole 702*h* and the engagement projection 705*e* is inserted into the engagement hole 703*h* and, thereby the coupling member 705 and the first reinforcement plate 702*d* are engaged and fixed on each other and so are the coupling member 705 and the second reinforcement plate 703*d*.

Figure 26:
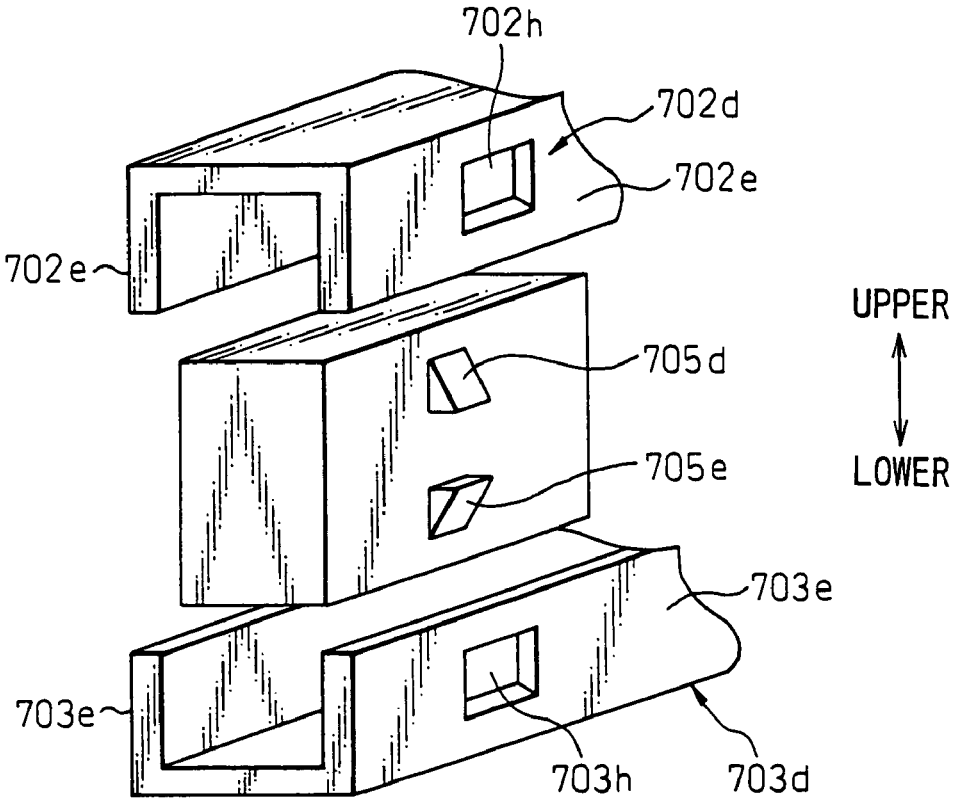
FIG. 26 is an exploded perspective view of a coupled part of a multiple heat exchanger according to a twelfth embodiment of the present invention.

In the present embodiment, the engagement projection 705*d* is formed into a tapered shape in which the dimension of projection becomes smaller toward the first heat exchange core 702*c* and the engagement projection 705*e* is formed into a tapered shape in which the dimension of projection becomes smaller toward the second heat exchange core 703*c* and, thereby it is possible to easily engage the coupling member 705 with the first and second reinforcement plates 702*d* and 703*d*, as shown in FIG. 26.

The coupling member in the present embodiment may be made of a metal, or a resin or an elastic material.

(Thirteenth Embodiment)

In a thirteenth embodiment, the portions at which the engagement projections 705*d* and 705*e* are inserted into the engagement holes 702*h* and 703*h*, that is, the engagement holes 702*h* and 703*h* are filled with an adhesive or a hardening agent (for example, rubber, epoxy, silicone, etc.) in a state in which the engagement projections 705*d* and 705*e* are inserted into the engagement holes 702*h* and 703*h*.

Due to this, it is possible to prevent, without fail, the engagement of the engagement projections 705*d* and 705*e* and the engagement holes 702*h* and 703*h* from being broken.

(Fourteenth Embodiment)

Figure 27:
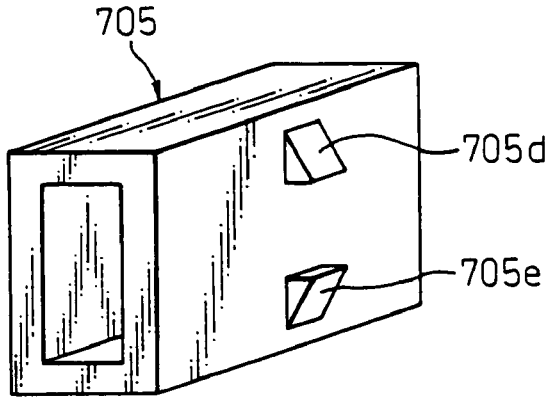
FIG. 27 is a perspective view of a coupling member according to a fourteenth embodiment of the present invention.

The coupling member 705 according to the embodiments described above is a solid block within which no blank exists, but in a fourteenth embodiment, the coupling member 705 is made into a hollowed body in order to reduce the weight thereof, as shown in FIG. 27.

It is preferable that the coupling member 705 in the present embodiment be made of a metal or a hard resin.

(Fifteenth Embodiment)

Figure 28:
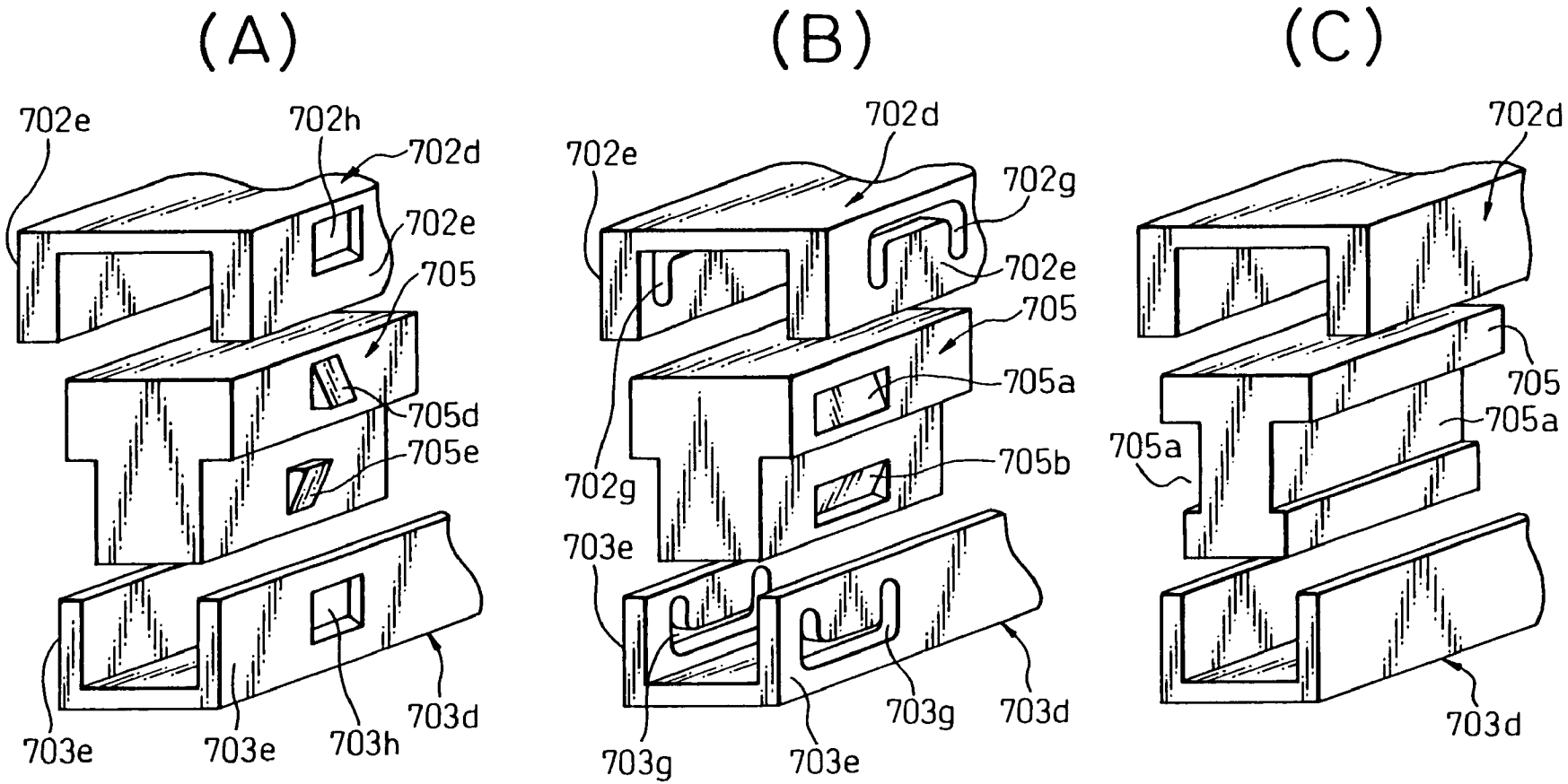
FIG. 28 is an exploded perspective view of coupled parts of a multiple heat exchanger according to a fifteenth embodiment of the present invention.

In the embodiments described above, the width of the first reinforcement plate 702*d* (the first heat exchange core 702*c*) is equal to the width of the second reinforcement plate 703*d* (the second heat exchange core 703*c*), but in a fifteenth embodiment, the present invention is applied to the multiple heat exchanger 701, in which the width of the first reinforcement plate 702*d* is different from the width of the second reinforcement plate 703*d*, as shown in FIG. 28.

FIG. 28 (A) shows a case where the present embodiment is applied to the multiple heat exchanger 701 according to the eighth embodiment, FIG. 28 (B) shows a case where the present embodiment is applied to the multiple heat exchanger 701 according to the eleventh embodiment, and FIG. 28 (C) shows a case where the present embodiment is applied to the multiple heat exchanger 701 according to the twelfth embodiment.

(Other Embodiments)

In the embodiments described above, the first heat exchanger is assumed to be a radiator for cooling an inverter etc., and the second heat exchanger is assumed to be the outdoor heat exchanger 3 for an air-conditioner, but the present invention is not limited to the above, and the first heat exchanger may be assumed to be, for example, an oil cooler, or the first heat exchanger may be assumed to be the first radiator 2 and the second heat exchanger may be assumed to be the second radiator 4.

The fastening means described in claims is not limited to the bolt 5 or the rivet 5*b* shown in the embodiments described above.

In the embodiments described above, a multiple heat exchanger is described, in which heat exchangers are coupled by a coupling member in a state in which tubes are arranged so as to extend substantially in the horizontal direction. However, any multiple heat exchanger may be acceptable, in which heat exchangers are coupled in a state in which the longitudinal direction of the tubes in the first heat exchange and that of tubes in the second heat exchanger extend in the same direction. For example, a multiple heat exchanger may be acceptable, in which heat exchangers are coupled in a state in which the longitudinal direction of tubes thereof extend substantially in the vertical direction.

The fixing means for fixing the coupling member 705 and both the first reinforcement plate 702*d* and second reinforcement plate 703*d* is not limited to the means shown in the embodiments described above.

The present invention is not limited to the embodiments described above, but at least two of the embodiments may be combined, for example.

In the embodiments described above, the present invention is applied to a cooling device and a multiple heat exchanger for a vehicle, but the present invention is not limited to these embodiments.

The present invention is not limited to the embodiments described above, as long as the concept of the invention described in the scope of claims is observed.

While the invention has been described by reference to specific embodiments chosen for the purposes of illustration, it should be apparent that numerous modifications could be made thereto by those skilled in the art without departing from the basic concept and scope of the invention.

What is claimed is:

1. A multiple heat exchanger comprising:

a first heat exchanger having a heat exchange core including a plurality of tubes through which a fluid flows and fins provided on outer surfaces of the tubes, and reinforcement plates for reinforcing the heat exchange core;

a second heat exchanger arranged in parallel to the first heat exchanger in an air flow direction, having a heat exchange core including a plurality of tubes through which a fluid flows and fins provided on the outer surfaces of the tubes, and reinforcement plates for reinforcing the heat exchange core; and fastening means for mechanically coupling the respective reinforcement plates of the first heat exchanger and the reinforcement plates of the second heat exchanger in a state in which the reinforcement plates are to next to, and overlap, each other in series in the air flow direction; wherein both the reinforcement plates have wall surfaces in opposition to each other in an air flow direction and the cross sections of which are formed substantially into a laid-down U-shape, are coupled by the fastening means in a state in which the wall surfaces are to next to, and overlap, each other in series in the air flow direction; the fastening means includes a bolt penetrating through the wall surfaces; and a block having a recess through which the bolt penetrates is arranged between two wall surfaces in order to prevent buckling of the reinforcement plate.

2. A multiple heat exchanger comprising:

a first heat exchanger having a first heat exchange core including a plurality of tubes through which a fluid flows and fins provided on outer surfaces of the tubes, a first side plate provided on a first engagement surface formed in a direction of thickness of the first heat exchanger core, and a first engagement plate spaced from the first side plate, one end of the first engagement plate being fixed to the first side plate via a connection part, a first slot being defined between the first side plate and the first engagement plate; and a second heat exchanger having a second heat exchange core including a plurality of tubes through which a fluid flows and fins provided on outer surfaces of the tubes, a second side plate provided on a second engagement surface formed in a direction of thickness of the second heat exchange core, and a second engagement plate spaced from the second side plate, one end of the second engagement plate being fixed to the second side plate via a connection part, a second slot being defined between the second side plate and the second engagement plate; wherein the first heat exchanger and the second heat exchanger are assembled so that the first engagement plate is located in the second slot, and the second engagement plate is located in the first slot.

3. The multiple heat exchanger as set forth in claim 2, wherein the first engagement plate is arranged in parallel to the first engagement surface and the second engagement plate is arranged in parallel to the second engagement surface.

4. The multiple heat exchanger as set forth in claim 3, wherein the size of the space between the first engagement plate and the first engagement surface is made substantially equal to the thickness of the second engagement plate, and the size of the space between the second engagement plate and the second engagement surface is made substantially equal to the thickness of the first engagement plate.

5. The multiple heat exchanger as set forth in claim 2, wherein the first engagement plate has a stop part at the end thereof in a direction of width perpendicular to the direction of thickness of the first heat exchange core, and wherein the stop part is formed by extending the end in a direction toward the first side plate.

6. The multiple heat exchanger as set forth in claim 2, wherein the first side plate has a stop part at the end thereof in the direction of width perpendicular to the direction of thickness of the first heat exchange core, and wherein the stop part is formed by extending the end in the direction toward the first engagement plate.

7. The multiple heat exchanger as set forth in claim 2, wherein the first side plate has a stop part at an end thereof near the opening in a direction of thickness of the first heat exchange core, and wherein the stop part is formed by extending the end in a direction toward the first engagement plate.

8. The multiple heat exchanger as set forth in claim 2, wherein:

the first engagement plate has insertion protrusions facing the first side plate; and the second engagement plate has insertion recesses facing the second side plate; and wherein the insertion protrusions are inserted into the insertion recesses.

9. The multiple heat exchanger as set forth in claim 2, further comprising at least a join part (539) at which an end of the first side plate and at least one of the end of the second side plate and the connection part of the second side plate are joined.

10. The multiple heat exchanger as set forth in claim 2, further comprising at least a join part at which an end of the first engagement plate and an end of at least one of the second engagement plate and the second side plate are joined.

11. A multiple heat exchanger comprising:

a first heat exchanger having a first heat exchange core including a plurality of tubes through which a fluid flows and fins provided on an outer surfaces of the tubes and a first side plate which is provided on a first engagement surface of the first heat exchange core formed in an air flow direction and on which a first engagement part having a U-shaped cross section in a plane perpendicular to the air flow direction is formed; and a second heat exchanger having a second heat exchange core including a plurality of tubes through which a fluid flows and fins provided on outer surfaces of the tubes and a second side plate which is provided on a second engagement surface of the second heat exchange core formed in an air flow direction and on which a second engagement part having a U-shaped cross section in a plane perpendicular to the air flow direction is formed; wherein the first heat exchanger and the second heat exchanger are joined by means of the engagement between the first engagement part and the second engagement part by sliding the first engagement part and the second engagement part toward each other in a plane formed in the air flow direction.

12. A multiple heat exchanger comprising:

a first heat exchange core having a plurality of tubes through which a fluid flows and fins provided an outer surfaces of the tubes;

a first reinforcement plate arranged at an end of the first heat exchange core to reinforce the first heat exchange core, the first reinforcement plate having two wall surfaces in opposition to each other in the air flow direction, and a cross section of the first reinforcement plate being formed substantially into a U-shape;

a second heat exchange core having a plurality of tubes through which a fluid flows and fins provided an outer surfaces of the tube;

a second reinforcement plate arranged at an end of the second heat exchange core to reinforce the second heat exchange core, the second reinforcement plate having two wall surfaces in opposition to each other in the air flow direction, and a cross section of the second reinforcement plate being formed substantially into a U-shape; and a separate coupling member arranged between the two wall surfaces of the first reinforcement plate and between the two wall surfaces of the second reinforcement plate, the first reinforcement plate and the second reinforcement plate extending into an aperture defined by the coupling member to couple the first reinforcement plate and the second reinforcement plate.

13. The multiple heat exchanger as set forth in claim 12, wherein the coupling member and the first reinforcement plate are engaged by inserting insertion projections formed on at least one of the coupling member and the first reinforcement plate into insertion holes formed in the other, that is, the coupling member or the first reinforcement plate on which the insertion projections are not formed.

14. The multiple heat exchanger as set forth in claim 12, wherein the coupling member and the second reinforcement plate are engaged by inserting insertion projections formed on at least one of the coupling member and the second reinforcement plate into insertion holes formed in the other, that is, the coupling member or the second reinforcement plate on which the insertion projections are not formed.

15. The multiple heat exchanger as set forth in claim 13, wherein the insertion parts of the insertion projections and the insertion holes are filled with an adhesive or a hardening agent.

16. The multiple heat exchanger as set forth in claim 12, wherein the coupling member and the first reinforcement plate are fixed on each other by caulking in which at least a part of the first reinforcement plate is plastically deformed toward the coupling member.

17. The multiple heat exchanger as set forth in claim 12, wherein the coupling member and the second reinforcement plate are fixed on each other by calking in which at least a part of the second reinforcement plate is plastically deformed toward the coupling member.

18. The multiple heat exchanger as set forth in claim 12, wherein the coupling member is made of a metal or a resin.

19. The multiple heat exchanger as set forth in claim 12, wherein the coupling member is made of an elastically deformable material.

20. The multiple heat exchanger as set forth in claim 19, wherein the coupling part of the coupling member with the first reinforcement plate and the second reinforcement plate is provided with reinforcement members to prevent the coupling member from being deformed.

21. The multiple heat exchanger as set forth in claim 12, wherein the width of the first reinforcement plate and the width of the second reinforcement plate are different from each other.

22. A multiple heat exchanger comprising:

a first heat exchanger having a first heat exchange core including a plurality of tubes though which a fluid flows and fins provided on an outer surfaces of the tubes, a first side plate provided on a first engagement surface formed in a direction of thickness of the first heat exchange core, and a first engagement plate spaced from the first side plate, one end of the first engagement plate being fixed on the first side plate via a connection part, a first slot defined between the the first engagement plate and the first side plate; and a second heat exchanger having a second heat exchange core including a plurality of tubes through which a fluid flows and fins provided an outer surfaces of the tubes, a second side plate provided on a second engagement surface formed in a direction of thickness of the second of the second heat exchange core, and a second engagement plate spaced from the second side plate, one end of the second engagement plate being fixed on the second side plate via a connection part, a second slot defined between the second engagement plate and the second side plate; wherein the first side plate of the first heat exchanger and the second side plate of the second heat exchanger are arranged in a state in which the first side plate overlaps the second side plate.

* * * * *